United States Patent [19]

Saito et al.

[11] Patent Number: 4,690,889

[45] Date of Patent: Sep. 1, 1987

[54] SILVER HALIDE COLOR PHOTOGRAPHIC LIGHT-SENSITIVE MATERIAL CONTAINING NOVEL CYAN DYE FORMING COUPLER

[75] Inventors: Naoki Saito; Kozo Aoki; Yukio Yokota, all of Kanagawa, Japan

[73] Assignee: Fuji Photo Film Co., Ltd., Kanagawa, Japan

[21] Appl. No.: 732,771

[22] Filed: May 10, 1985

[30] Foreign Application Priority Data

| | | | |
|---|---|---|---|
| May 10, 1984 | [JP] | Japan | 59-93605 |
| Dec. 14, 1984 | [JP] | Japan | 59-264277 |
| Dec. 19, 1984 | [JP] | Japan | 59-268135 |

[51] Int. Cl.[4] ..... G03C 1/40; G03C 1/08; G03C 7/32

[52] U.S. Cl. ..... 430/552; 430/548; 430/553; 430/558

[58] Field of Search ..... 430/548, 552, 553, 558

[56] References Cited

U.S. PATENT DOCUMENTS

| | | | |
|---|---|---|---|
| 3,767,411 | 10/1973 | Kishimoto et al. | 430/552 |
| 3,926,436 | 12/1975 | Monbaliu et al. | 430/548 |
| 4,083,721 | 4/1978 | Inouye et al. | 430/552 |
| 4,128,427 | 12/1978 | Monbaliu et al. | 430/552 X |
| 4,254,212 | 3/1981 | Yagihara et al. | 430/552 X |
| 4,296,199 | 10/1981 | Yagihara et al. | 430/553 X |
| 4,419,439 | 12/1983 | Kuwazima et al. | 430/552 X |
| 4,433,050 | 2/1984 | Abe et al. | 430/552 X |

FOREIGN PATENT DOCUMENTS

| | | | |
|---|---|---|---|
| 0125522 | 11/1984 | European Pat. Off. | 430/552 |

*Primary Examiner*—John E. Kittle
*Assistant Examiner*—Mukund J. Shah
*Attorney, Agent, or Firm*—Sughrue, Mion, Zinn, Macpeak, and Seas

[57] ABSTRACT

A silver halide color photographic light-sensitive material containing a specific naphthol cyan dye forming coupler is disclosed. Dye images formed by this coupler are excellent in fastness to heat and light and in sharpness, and are free from adverse influences of a bleaching solution having weak oxidative activity or a fatigued bleaching solution.

20 Claims, No Drawings

SILVER HALIDE COLOR PHOTOGRAPHIC LIGHT-SENSITIVE MATERIAL CONTAINING NOVEL CYAN DYE FORMING COUPLER

FIELD OF THE INVENTION

This invention relates to a silver halide color photographic light-sensitive material containing a novel cyan dye forming coupler.

BACKGROUND OF THE INVENTION

Color image formation in silver halide photographic light-sensitive materials can be achieved by exposure to light and color development, upon which an oxidation product of an aromatic primary amine developing agent is reacted with a dye forming coupler. In this image formation system, color reproduction is generally realized by a subtractive color process, in which blue, green and red colors are reproduced by forming yellow, magenta and cyan dye images that are complementary to the former, respectively. The cyan dye forming couplers most often employed are phenol dyes and naphthol dyes.

Dye images obtained from conventionally employed phenol dyes or naphthol dyes have several problems, however, in terms of preservability. For example, dye images obtained from 2-acylaminophenol cyan couplers disclosed in U.S. Pat. Nos. 2,367,531 and 2,423,730 are, in general, inferior in heat fastness; dye images formed from 2,5-diacylaminophenol cyan couplers disclosed in U.S. Pat. Nos. 2,369,929 and 2,772,162 generally have poor light fastness; and those obtained from 1-hydroxy-2-naphthamide cyan couplers are unsatisfactory in both light- and heat-fastness.

On the other hand, it is known that when a polymeric coupler prepared by polymerization of a monomer coupler is added to a hydrophilic colloid composition in the form of a latex, not only is the film prepared therefrom free from deterioration in strength, but also a coupler unit can easily be incorporated in an emulsion at a high concentration since the latex can contain the coupler unit at a high concentration. In addition, such a composition can be formed in a thin film because of suppression of viscosity, so that the resulting materials exhibit improved image sharpness.

Examples of such polymer coupler latexes incorporated in gelatin silver halide emulsions include 4-equivalent magenta polymer coupler latexes and processes for the production thereof as described in U.S. Pat. Nos. 4,080,211 and 3,451,820 and British Pat. No. 1,247,688, latexes of copolymers with competing couplers as described in West German Pat. No. 2,725,591 and U.S. Pat. No. 3,926,436, and cyan polymer coupler latexes synthesized by the emulsion-dispersion method as described in *Research Disclosure* RD No. 21728, pp 188–190 (May, 1982).

However, these known cyan polymer coupler latexes are still somewhat unsatisfactory despite the above-described advantages, and improvement in heat- and light-fastness and sharpness of dye images has been desired.

Further, conventionally employed phenol and naphthol cyan couplers have been noted to have drawbacks such as that the dye images formed therefrom by color development have poor fastness to heat or light and that reduction of color density takes place when development processing is carried out using a bleaching solution with weak oxidative activity or a fatigued bleaching solution. In order to overcome these disadvantages, phenol type cyan couplers having a phenylureido group at the 2-position and a carbonamido group at the 5-position have been proposed, as disclosed, e.g., in Japanese Patent Application (OPI) Nos. 65134/81, 204543/82, 204544/82, 204545/82, 33249/83 and 33250/83 (the term "OPI" as used herein refers to a "published unexamined Japanese patent application"), etc. It is certain that the 2-phenylureido-substituted couplers are superior to the known phenol cyan couplers or naphthol cyan couplers with respect to the above-mentioned points. Nevertheless, these cyan couplers still involve a disadvantage in that spectral absorption of a developed color image widely varies from shorter wavelength absorption to longer wavelength absorption, depending on the color density.

SUMMARY OF THE INVENTION

Accordingly, an object of this invention is to provide a naphthol type cyan dye forming coupler (also referred to more simply as a "cyan coupler") capable of forming dye images excellent in heat- and light-fastness.

Another object of this invention is to provide a silver halide color photographic light-sensitive material containing a naphthol type cyan dye forming coupler, which can form sharp images.

A further object of this invention is to provide a silver halide color photographic light-sensitive material containing a naphthol type cyan dye forming coupler, which undergoes little reduction in color density even when developed using a bleaching solution with weak oxidative activity or a fatigued bleaching solution.

As result of extensive investigations, it has now been found that the above-described objects can be accomplished by a silver halide color photographic light-sensitive material containing a cyan dye forming coupler represented by formula (I)

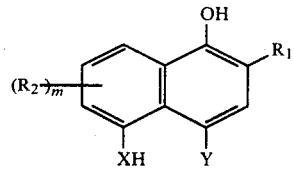

(I)

wherein $R_1$ represents $CONR^3R^4$, $—NHCOR_3$, $—NHCOOR_5$, $—NHSO_2R_5$, $—NHCONR_3R_4$ or $—NHSO_2NR_3R_4$, wherein $R_3$ and $R_4$ (which may be the same or different) each represents a hydrogen atom or an aliphatic, aromatic, or heterocyclic group, and $R_5$ represents an aliphatic, aromatic, or heterocyclic group; $R_2$ represents a group capable of substituting a hydrogen atom of the naphthol ring; m represents 0 or an integer of from 1 to 3; X represents an oxygen atom, a sulfur atom or

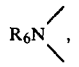

wherein $R_6$ represents a hydrogen atom or a monovalent organic group; and Y represents a hydrogen atom or a group capable of being released in a coupling reaction with an oxidation product of an aromatic primary amine developing agent; when m is 2 or 3, the plural $R_2$ groups can be the same or different, or together form a ring; or $R_2$ and X, X and Y, or $R_3$ and $R_4$ together form a ring; or formula (I) represents a dimer or a higher polymer by bonding at $R_1$, $R_2$, X or Y.

DETAILED DESCRIPTION OF THE INVENTION

The terminology "aliphatic group" as used herein means a straight chain, branched chain or cyclic, saturated or unsaturated, and substituted or unsubstituted alkyl, alkenyl or alkynyl group. Typical examples thereof include a methyl group, an ethyl group, a butyl group, a cyclohexyl group, an allyl group, a propargyl group, a methoxyethyl group, an n-decyl group, an n-dodecyl group, an n-hexadecyl group, a trifluoromethyl group, a heptafluoropropyl group, a dodecyloxypropyl group, a 2,4-di-t-amylphenoxypropyl group, a 2,4-di-t-amylphenoxybutyl group, and the like.

The terminology "aromatic group" as used herein means a substituted or unsubstituted aryl group (including a condensed ring). Typical examples thereof include a phenyl group, a tolyl group, a 2-tetradecyloxyphenyl group, a pentafluorophenyl group, a 2-chloro-5-dodecyloxycarbonylphenyl group, a 4-chlorophenyl group, a 4-cyanophenyl group, a 4-hydroxyphenyl group, and the like.

The terminology "heterocyclic group" as used herein means a substituted or unsubstituted monocyclic or condensed heterocyclic ring. Typical examples thereof are a 2-pyridyl group, a 4-pyridyl group, a 2-furyl group, a 4-thienyl group, a quinolinyl group, and the like.

In the above-described formula (I), $R_1$ represents $CONR^3R^4$, $—NHCOR_3$, $—NHCOOR_5$, $—NHSO_2R_5$, $—NHCONR_3R_4$ or $—NHSO_2NR_3R_4$. $R_3$, $R_4$, and $R_5$ each preferably represents an aliphatic group having from 1 to 30 carbon atoms, an aromatic group having from 6 to 30 carbon atoms, or a heterocyclic group having from 2 to 30 carbon atoms.

$R_2$ represents a group or atom capable of substituting for a hydrogen atom on the naphthol ring and typically includes a halogen atom, a hydroxyl group, an amino group, a carboxyl group, a sulfo group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, an imido group, and the like. Preferably, the total carbon atom number contained in $R_2$ is from 0 to 30. When m is 2, the cyclic group formed by $R_2$ includes a dioxymethylene group.

X represents an oxygen atom, a sulfur atom or

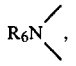

wherein $R_6$ is a hydrogen atom or a monovalent group. The monovalent group as represented by $R_6$ is preferably represented by the formula (II)

$$R_7(Y')_l— \quad (II)$$

wherein Y' represents an imino group, a carbonyl group or a sulfonyl group; l represents 0 or 1; and $R_7$ represents a hydrogen atom, an aliphatic group having from 1 to 30 carbon atoms, an aromatic group having from 6 to 30 carbon atoms, a heterocyclic group having from 2 to 30 carbon atoms, a hydroxyl group, $—OR_3$, $—COR_3$, $—SO_2R_3$ or

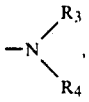

wherein $R_3$ and $R_4$ (which may be the same or different) each is as defined above.

$R_3$ and $R_4$ in $—NR_3R_4$ for $R_1$ or $R_7$ can together form a nitrogen-containing heterocyclic ring (e.g., a morpholine ring, a piperidine ring, a pyrrolidine ring, etc.).

Y represents a hydrogen atom or a group or atom releasable upon coupling. Typical examples of the coupling-releasable group or atom include a halogen atom, $—OR_8$, $—SR_8$,

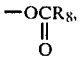

$—NHCOR_8$, $—NHOS_2R_8$,

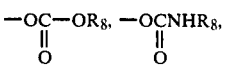

an aromatic azo group having from 6 to 30 carbon atoms, a heterocyclic group having from 1 to 30 carbon atoms and capable of bonding to the coupling position of a coupler via a nitrogen atom thereof (e.g., a succinimido group, a phthalimido group, a hydantoinyl group, a pyrazolyl group, a 2-benzotriazolyl group, etc.), and the like, wherein $R_8$ represents an aliphatic group having from 1 to 30 carbon atoms, an aromatic group having from 6 to 30 carbon atoms or a heterocyclic group having from 2 to 30 carbon atoms.

In the present invention, $R_1$ preferably represents $—CONR_3R_4$, with specific examples thereof including a carbamoyl group, an ethylcarbamoyl group, a morpholinocarbonyl group, a dodecylcarbamoyl group, a hexadecylcarbamoyl group, a decyloxypropyl group, a dodecyloxypropyl group, a 2,4-di-t-amylphenoxypropyl group, a 2,4-di-t-amylphenoxybutyl group, etc.

m for $R_2$ is preferably 0. When m is 1 or more, acceptable substituents as $R_2$ include a halogen atom, an aliphatic group, a carbonamido group, a sulfonamido group, and the like.

X preferably represents

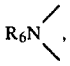

wherein $R_6$ includes $—COR_7$ (e.g., a formyl group, an acetyl group, a trifluoroacetyl group, a chloroacetyl group, a benzoyl group, a pentafluorobenzoyl group, a p-chlorobenzoyl group, etc.), $—COOR_3$ (e.g., a methoxycarbonyl group, an ethoxycarbonyl group, a butoxycarbonyl group, a decyloxycarbonyl group, a methoxyethoxycarbonyl group, a phenoxycarbonyl group, etc.), $—SO_2R_7$ (a methanesulfonyl group, an ethanesulfonyl group, a butanesulfonyl group, a hexadecanesulfonyl group, a benzenesulfonyl group, a toluenesulfonyl group, a p-chlorobenzenesulfonyl group, etc.), —$CONR_3R_4$ (e.g., an N,N-dimethylcarbamoyl group, an N,N-diethylcarbamoyl group, an N,N-dibutylcarbamoyl group, a morpholinocarbonyl group, a piperidinocarbonyl group, a 4-cyanophenylcarbonyl group, a 3,4-dichlorophenylcarbamoyl group, a 4-methanesulfonylphenylcarbamoyl group, etc.), and —$SO_2NR_3R_4$ (e.g., an N,N-dimethylsulfamoyl group, an N,N-diethylsulfamoyl group, an N,N-dipropylsulfamoyl group, etc.). The more preferred among them are —$COR_7$ and —$SO_2R_7$, wherein $R_3$ and $R_4$ are as defined above.

Y preferably includes a hydrogen atom, a halogen atom, an aliphatic oxy group, an aromatic oxy group, a heterocyclic thio group and an aromatic azo group.

The couplers represented by formula (I) may include dimers or higher polymers in which at least two coupler residues derived from formula (I) are bonded together at the position for substituent $R_1$, $R_2$, X or Y via a divalent or higher valent group. In such cases, of course, each substituent constituting the coupler residue may have a carbon atom number out of the above-recited range.

In the cases where the couplers of formula (I) form polymers, such polymer couplers typically include homopolymers or copolymers of addition polymerizable ethylenically unsaturated compounds having a cyan dye forming coupler residue (hereinafter referred to as cyan forming monomers). Such homo- or copolymers contain a repeating unit represented by the following formula (III). The polymers may contain one or more kinds of the repeating units of the formula (III), and also may be copolymers containing one or more of non-color forming ethylenically unsaturated monomers as comonomers:

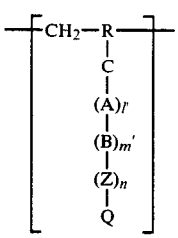

(III)

wherein R represents a hydrogen atom, a chlorine atom or an alkyl group of from 1 to 4 carbon atoms; A represents —CONH—, —COO— or a substituted or unsubstituted phenylene group; B represents a substituted or unsubstituted alkylene, phenylene or aralkylene group; Z represents —CONH—, —NHCONH—, —NHCOO—, —NHCO—, —OCONH—, —NH—, —COO—, —OCO—, —CO—, —O—, —S—, —$SO_2$—, —$NHSO_2$— or —$SO_2NH$—; l', m' and n each represents 0 or 1; and Q represents a cyan coupler residue derived from the compound represented by formula (I) by releasing a hydrogen atom from one of the groups $R_1$, $R_2$, XH and Y of the formula I.

The polymer is preferably a copolymer prepared from a cyan forming monomer that provides the coupler unit of the formula (III) (hereinafter referred to as vinyl monomer) and a non-color forming ethylenically unsaturated monomer or monomers.

The non-color forming ethylenically unsaturated monomers are those which do not commence coupling with an oxidation product of an aromatic primary amine developing agent and include acrylic acids, e.g., acrylic acid, α-chloroacrylic acid and α-alkylacrylic acids (e.g., methacrylic acid); esters or amides of these acrylic acids, e.g., acrylamide, methacrylamide, n-butylacrylamide, t-butylacrylamide, diacetoneacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxymethacrylates; vinyl esters, e.g., vinyl acetate, vinyl propionate and vinyl laurate; acrylonitrile; methacrylonitrile; aromatic vinyl compounds, e.g., styrene and derivatives thereof (e.g., vinyltoluene, divinylbeyzene, vinylacetophenone and sulfostyrene); itaconic acid; citraconic acid; crotonic acid; vinylidene chloride; vinyl alkyl ethers, e.g., vinyl ethyl ether; maleic esters; N-vinyl-2-pyrrolidone; N-vinylpyridine; 2- or 4-vinylpyridine; and so on. The preferred among them are acrylic esters, methacrylic esters and maleic esters. These non-color forming ethylenic monomers can be used alone or in combinations of two or more thereof. For example, combinations such as methyl acrylate-butyl acrylate, butyl acrylate-styrene, butyl methacrylate-methacrylic acid, methyl acrylate-diacetone acrylamide, and the like, can be used.

As is well known in the field of polymeric couplers, these ethylenically unsaturated comonomers to be copolymerized with the vinyl monomer which provides the repeating unit of the formula (III) can be appropriately selected so that the resulting copolymers may undergo favorable influences on their physical and chemical properties, for example, solubility, compatibility with binders of photographic colloid compositions, e.g., gelatin, flexibility, heat stability, and the like.

A photographic colloid composition using the oleophilic cyan polymer coupler of the present invention can be prepared by emulsifying an organic solvent solution of the polymer coupler in an aqueous gelatin solution in the form of a latex, or may be prepared by direct emulsion polymerization.

Incorporation of the oleophilic polymer coupler in a gelatin aqueous solution in the form of a latex is described, e.g., in U.S. Pat. No. 3,451,820; and the emulsion polymerization is described, e.g., in U.S. Pat. Nos. 4,080,211 and 3,370,952.

Synthesis of these cyan polymer couplers in accordance with the present invention can be carried out in the presence of polymerization initiators and polymerization solvents described in Japanese Patent Application (OPI) Nos. 5543/81, 94752/82, 176038/82, 204038/82, 28745/83, 10738/83, 42044/83 and 29683/82.

The polymerization temperature should be determined in relation to molecular weights of the resulting polymers, the kinds of initiators used, and the like within a range of from 0° C. to 100° C. or even higher, and usually from 30° C. to 100° C.

The proportion of the coupler unit of the formula (III) in the copolymer couplers preferably ranges from 5 to 80% by weight, and, from the standpoint of color reproducibility, color developability, and stability, more preferably ranges from 20 to 70% by weight.

The polymeric couplers according to the present usually have an equivalent molecular weight (i.e., a gram number of 1 mole of the polymer containing the coupler unit (III) of from about 250 to about 4,000, but the present invention is not limited thereto and low molecular weight polymers are also included within the scope thereof.
Specific examples of the couplers and coupler monomers included within the scope of the present invention are shown below, only for illustrative purposes, not for limitation. In the following structural formulae, $(t)C_5H_{11}$ represents $—C(CH_3)_2C_2H_5$ and $(t)C_8H_{17}$ represents $—C(CH_3)CH_2C(CH_3)_3$.
(1)
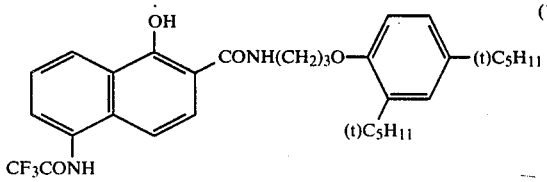
(2)
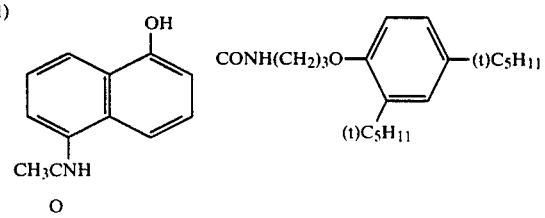
(3)
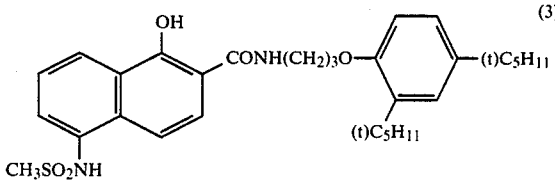
(4)
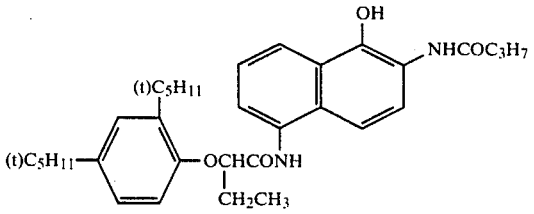
(5)
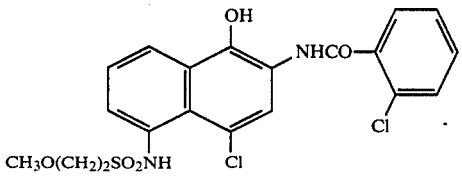
(6)
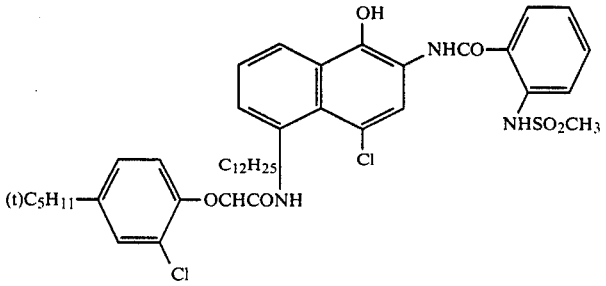
(7)
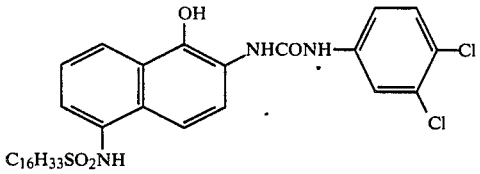
(8)
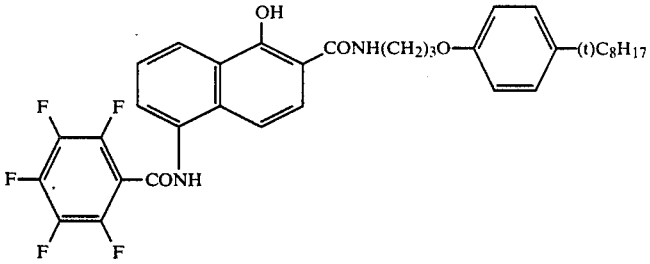
(9)
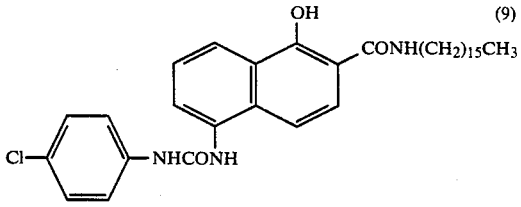
(10)
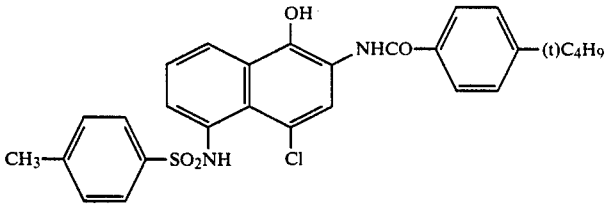
(11)
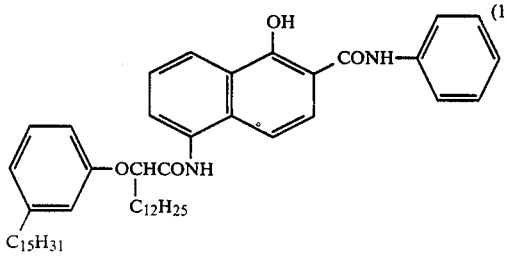
(12)
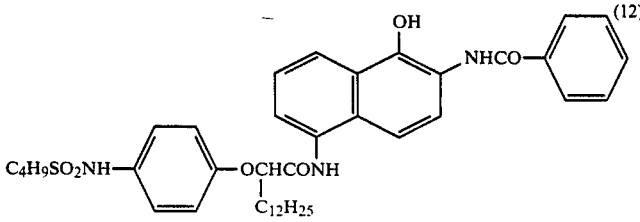

-continued
(13)
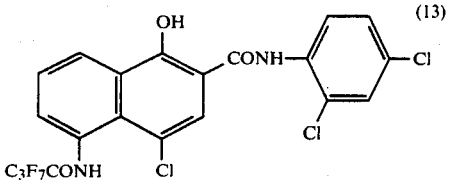
(14)
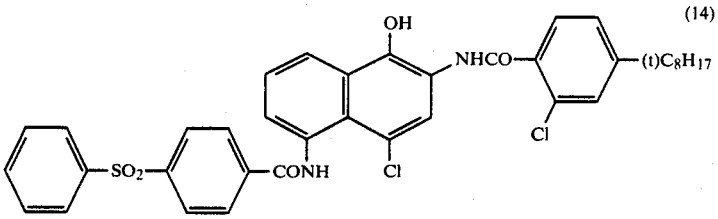
(15)
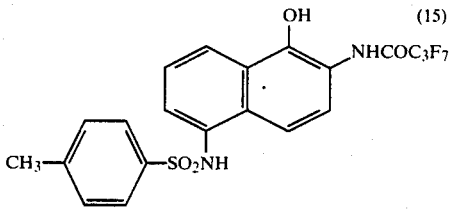
(16)
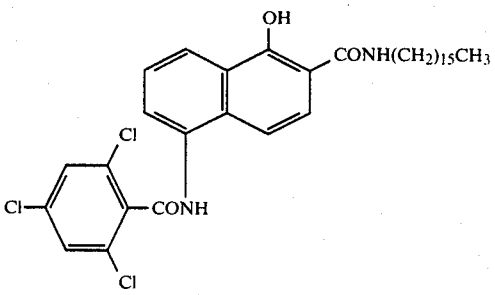
(17)
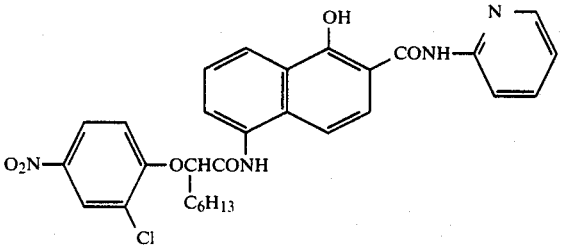
(18)
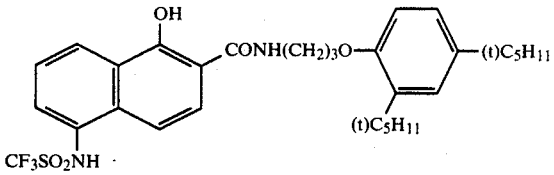
(19)
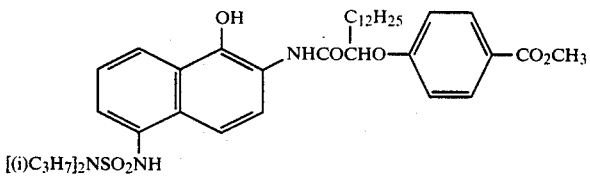
(20)
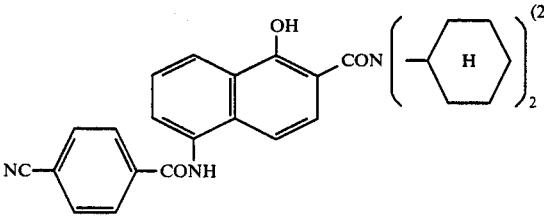
(21)
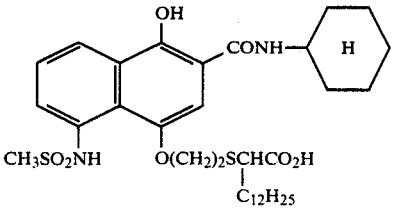
(22)
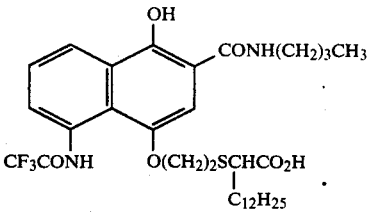
(23)
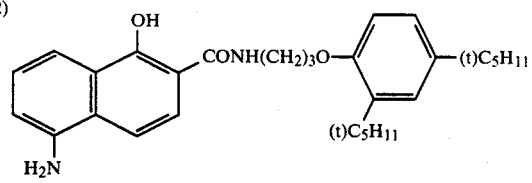
(24)
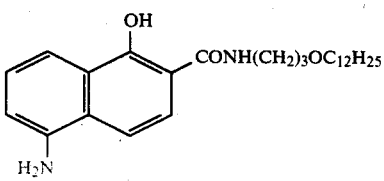
(25)
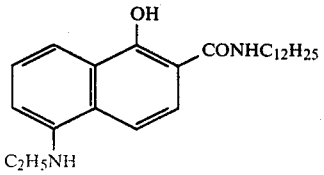

-continued
(26)
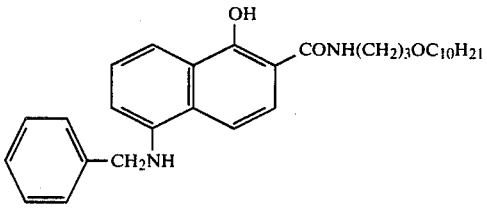
(27)
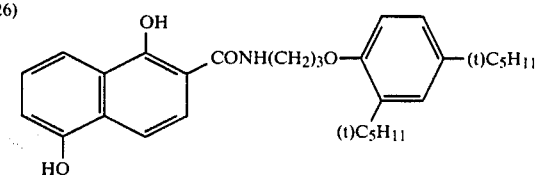
(28)
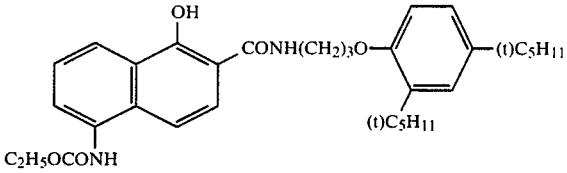
(29)
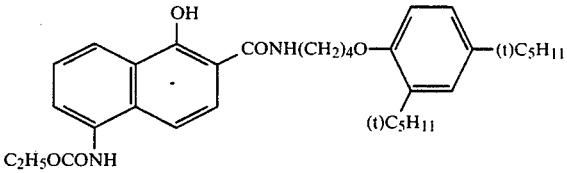
(30)
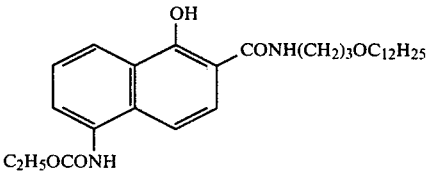
(31)
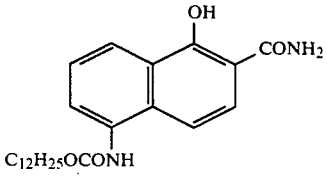
(32)
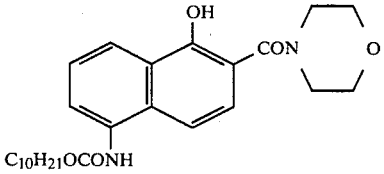
(33)
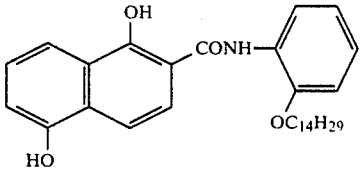
(34)
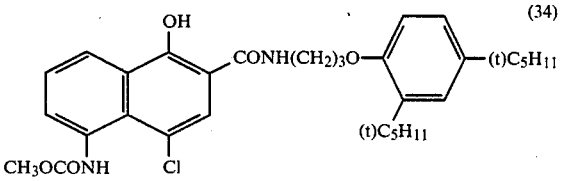
(35)
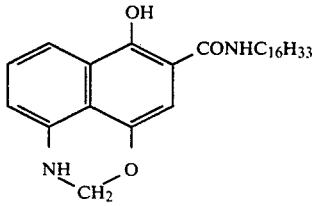
(36)
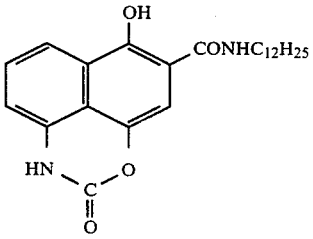
(37)
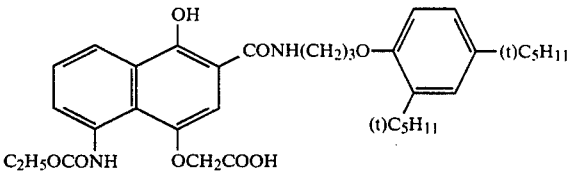
(38)
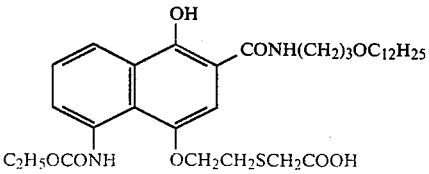
(39)
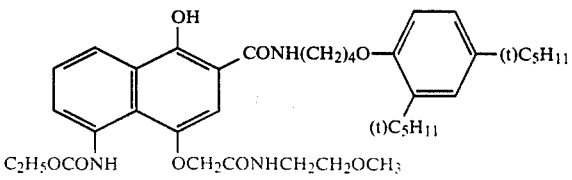

-continued
(40)
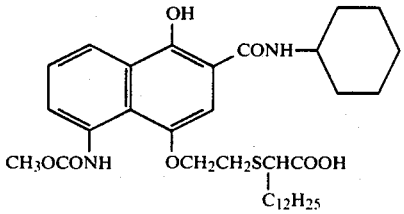
(41)
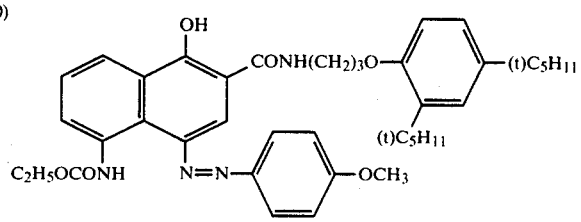
(42)
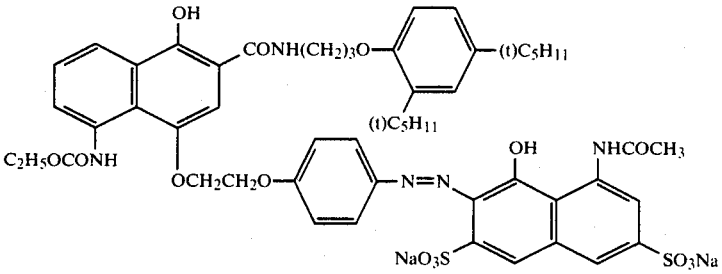
(43)
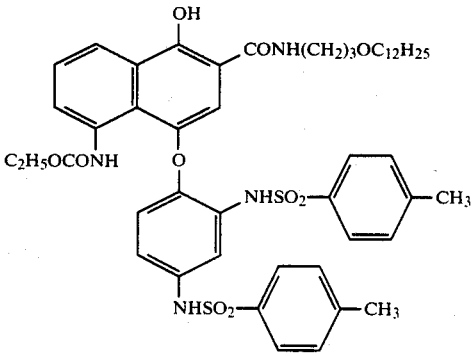
(44)
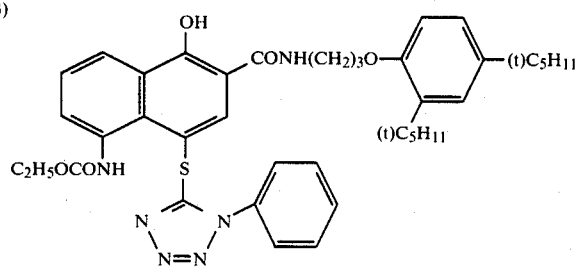
(45)
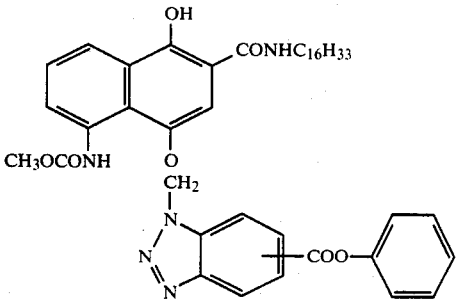
(46)
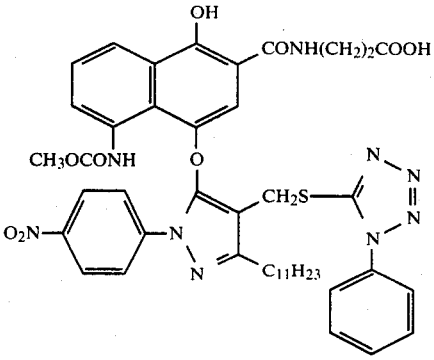
(47)
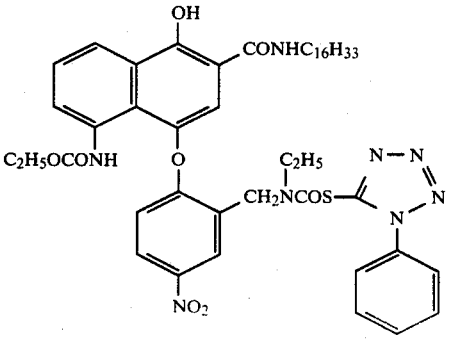

-continued
(48)
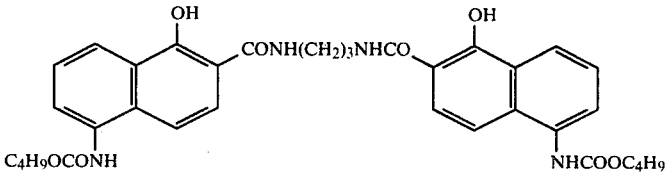
(49)
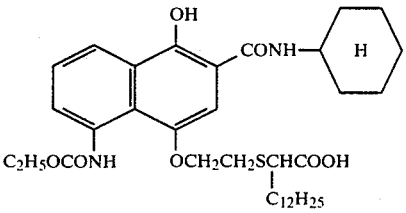
(50)
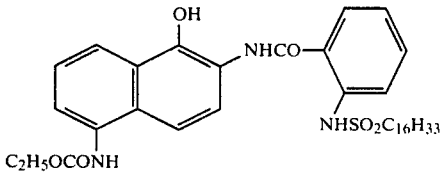
(51)
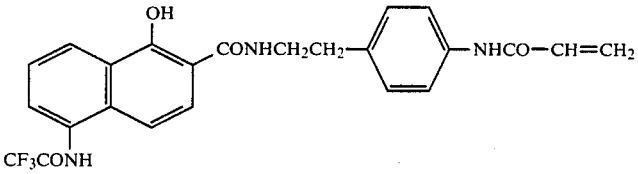
(52)
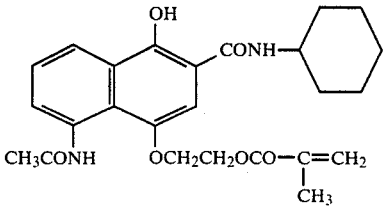
(53)
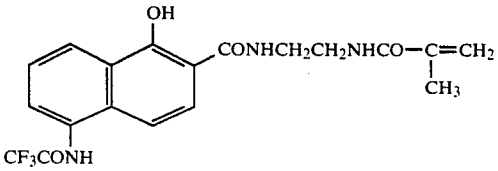
(54)
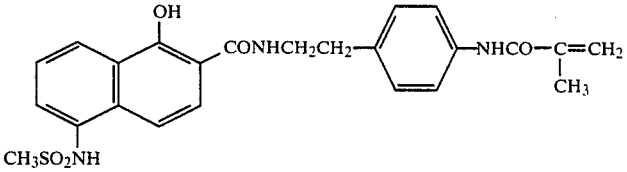
(55)
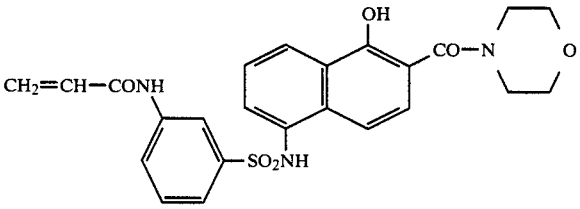
(56)
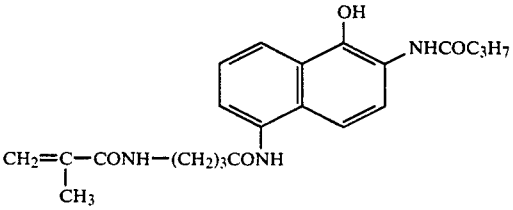
(57)
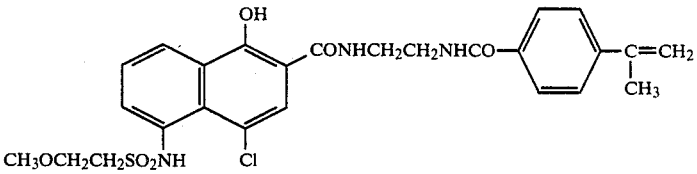
(58)
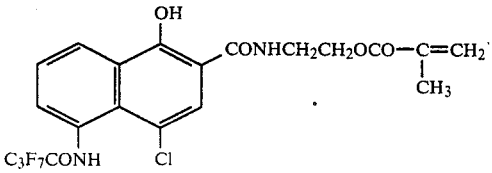
(59)
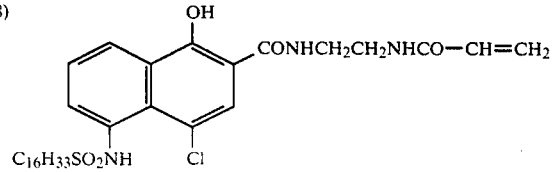

-continued
(60)
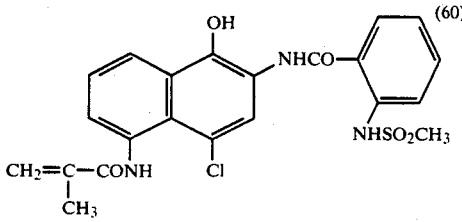
(61)
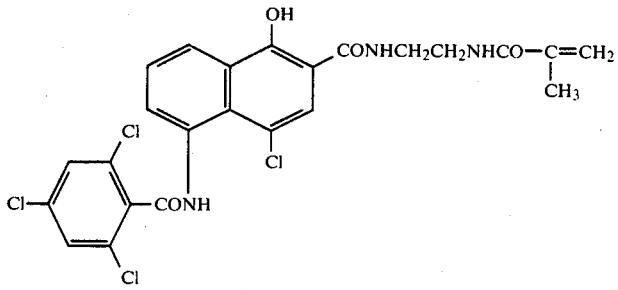
(62)
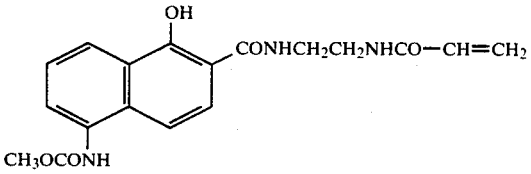
(63)
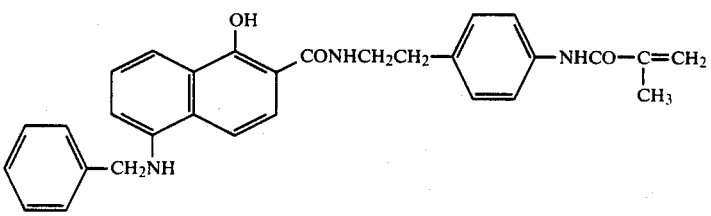
(64)
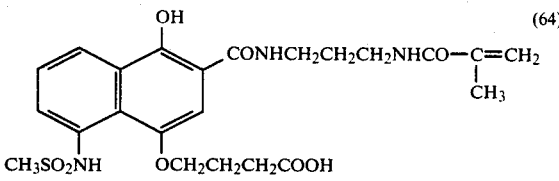
(65)
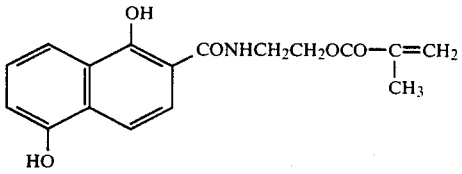
(66)
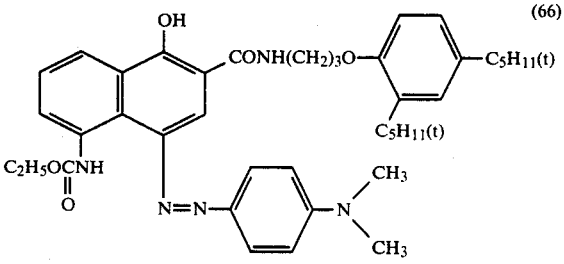
(67)
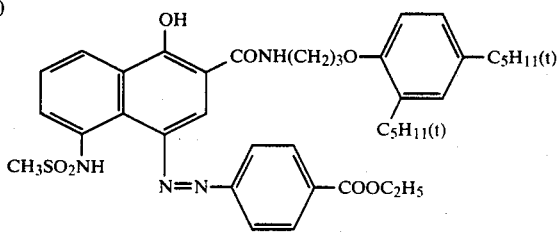
(68)
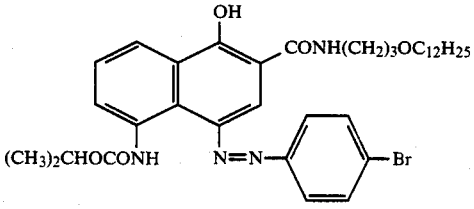
(69)
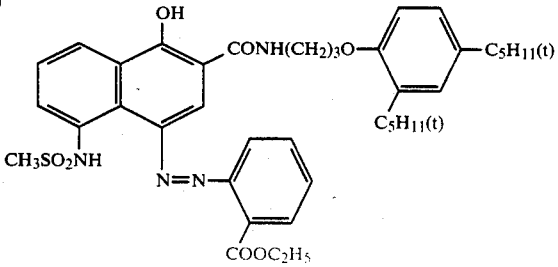

-continued (70)

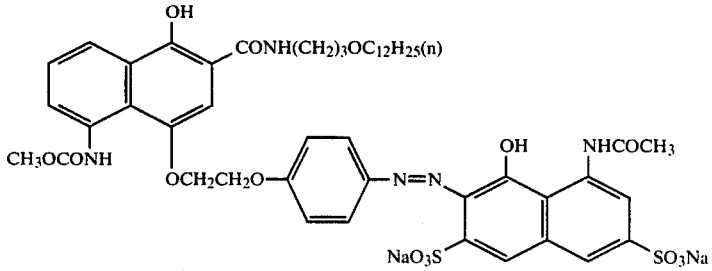

(71)

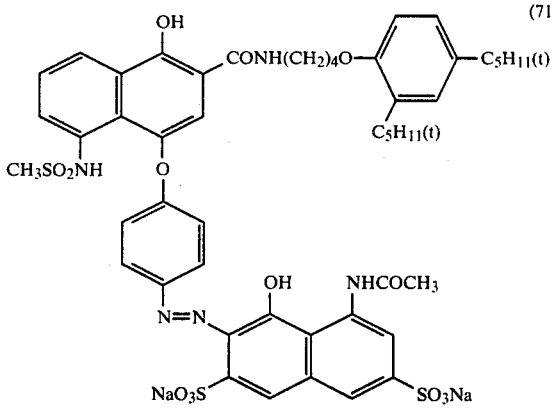

(72)

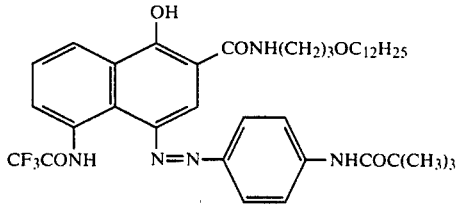

(73)

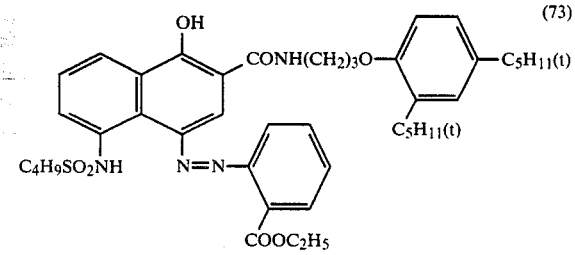

Synthesis examples of the couplers according to the present invention are shown below.

SYNTHESIS EXAMPLE 1

Synthesis of Coupler (1)

(1) Synthesis of 5-Trifluoroacetamido-1-Hydroxynaththoic Acid

In 100 ml of tetrahydrothiophene 1,1-dioxide was dispersed 20.3 g of 5-amino-1-hydroxynaphtholic acid, and 45 g of trifluoroacetic anhydride was added thereto. The mixture was stirred under heating at 80° C. for 2 hours. Twenty grams of water was added thereto. After stirring for 30 minutes, 200 ml of acetonitrile was added, followed by cooling. The thus formed precipitate was collected by filtration, washed with acetonitrile, and dried to obtain 21 g of 5-trifluoroacetamido-1-hydroxynaphthoic acid.

(2) Synthesis of p-Nitrophenyl 5-Trifluoroacetamido-1-Hydroxynaphthoate

In 1.5 liters of acetonitrile were dispersed 200 g of 5-trifluoroacetamido-1-hydroxynaphthoic acid and 100 g of p-nitrophenol, and the mixture was stirred under heating. To the dispersion was added 15 ml of dimethylformamide, and 110 ml of thionyl chloride was added thereto dropwise. After the dropwise addition, the mixture was heated while stirring for 1 hour, followed by cooling. The precipitate thus formed was collected by filtration, washed with acetonitrile, and dried to obtain 230 g of p-nitrophenyl 5-trifluoroacetamido-1-hydroxynaphthoate.

(3) Synthesis of Coupler (1)

In 200 ml of tetrahydrofuran was dispersed 42 g of p-nitrophenyl 5-trifluoroacetamido-1-hydroxynaphthoate, and the dispersion was stirred at room temperature. To the resulting solution was added 29 g of 3-(2,4-di-t-amylphenoxy)propylamine. After stirring for 5 hours, the resulting mixture was poured into 500 ml of water. The supernatant liquor was removed, and the resulting oily residue was dissolved in 200 ml of methanol while hot. Insoluble matter was separated by filtration, and the filtrate was cooled. The precipitated crystals were collected by filtration to obtain 61 g of Coupler (1) having a melting point of 151.5° to 152.2° C.

| | Elementary Analysis: | | |
|---|---|---|---|
| | H | C | N |
| Calcd. (%): | 6.87 | 67.11 | 4.89 |
| Found (%): | 6.97 | 67.11 | 4.82 |

SYNTHESIS EXAMPLE 2

Synthesis of Coupler (3)

(1) Synthesis of 5-Amino-1-Hydroxy-N-[3-(2,4-Di-t-Amylphenoxy)-Propyl]-2-Naphthamide In 200 ml of ethanol was dissolved 36 g of Coupler (1) as prepared in Synthesis Example 1, and a sodium hydroxide aqueous solution consisting of 20 g of sodium hydroxide and 50 ml of water was added to the resulting solution. The mixture was stirred at 60° C. for 2 hours in a nitrogen stream. Fourty milliliters of glacial acetic acid was added thereto, followed by cooling. The precipitate thus formed was collected by filtration, washed with 90% aqueous ethanol, and dried to yield 29 g of 5-amino-1-hydroxy-N-[3-(2,4-di-t-amylphenoxy)-propyl]-2-naphthamide.

(2) Synthesis of Coupler (3)

A solution of 13.5 g of methanesulfonyl chloride in 30 ml of acetonitrile was added dropwise to a solution consisting of 24 g of 5-amino-hydroxy-N-[3-(2,4-di-t-amylphenoxy)propyl]-2-naphthamide, 150 ml of acetonitrile and 20 ml of pyridine. After stirring for 2 hours, 20 ml of glacial acetic acid was added thereto in small portions. The precipitate thus formed was collected by filtration, washed with water, dried, and recrystallized from ethanol to obtain 19 g of Coupler (3) having a melting point of 182.0° to 182.5° C.

| | Elementary Analysis: | | |
|---|---|---|---|
| | H | C | N |
| Calcd. (%): | 7.63 | 67.12 | 5.05 |
| Found (%): | 7.77 | 67.22 | 4.99 |

SYNTHESIS EXAMPLE 3

Synthesis of Coupler (24)

In 300 ml of dimethylformamide were dissolved 71 g of 5-amino-1-hydroxy-2-naphthoic acid and 85 g of dodecyloxypropylamine. While heating the resulting solution at 60° to 70° C., a dimethylformamide solution of 72 g of dicyclohexylcarbodiimide was added thereto dropwise. The resulting mixture was heated while stirring for 3 hours, followed by ice-cooling. The thus precipitated crystals of dicyclohexylurea were removed by filtration. To the filtrate was added 500 ml of ethyl acetate, and the mixture was washed 3 times with 1 liter portions of water. The ethyl acetate layer was separated, dried over sodium sulfate and concentrated. The concentrate was purified by silica gel column chromatography to obtain 100 g of Coupler (24) as an oily product.

SYNTHESIS EXAMPLE 4

Synthesis of Coupler (30)

In 200 ml of acetonitrile were dissolved 37.8 g of Coupler (24) as prepared in Synthesis Example 2, and 10.8 g of ethyl chlorocarbonate was added thereto dropwise while stirring at room temperature. After the addition, the stirring was continued for an additional 3 hours. Two hundreds milliliters of ethyl acetate was added thereto, and the mixture was washed three times with 500 ml portions of water to obtain an ethyl acetate solution. The resulting solution was dried over sodium sulfate and concentrated. Crystallization of the concentrate from acetonitrile yielded 34 g of Coupler (30) having a melting point of 70° to 81° C.

SYNTHESIS EXAMPLE 5

Synthesis of Copolymer Coupler of 5-Trifluoroacetamido-1-Hydroxy-N-[2-(4-Acryloylamino)Ethyl]-2-Naphthamide [Monomer Coupler (51)] and Butyl Acrylate [Polymer Coupler (I)]

A mixture of 200 g of Monomer Coupler (51), 20 g of butyl acrylate and 200 ml of dioxane was heated to 80° C. with stirring in a nitrogen stream. To the mixture was added 10 ml of dioxane containing 500 mg of dimethyl azobisisobutyrate to initiate polymerization. After the reaction was continued for 5 hours, the reaction mixture was cooled and poured into 1 liter of water. The precipitated solid was collected by filtration, thoroughly washed with water, and dried by heating under reduced pressure to obtain 38.5 g of Polymer Coupler (I). The product was a mixture of polymer couplers having degrees of polymerization of from about 100 to about 5,000 with an average degree of polymerization being about 1,000.

Nitrogen analysis revealed that the polymer coupler contained 50.8 wt% of Monomer Coupler (1).

SYNTHESIS EXAMPLE 6

Synthesis of Copolymer Coupler of 2-Morpholinocarbonyl-5-(3-Acryloylaminophenyl)Sulfonamidonaphthol [Monomer Coupler (52)] and Ethyl Acrylate [Polymer Coupler (II)]

A mixture of 20 g of Monomer Coupler (52), 20 g of ethyl acrylate and 200 ml of n-propanol was heated to 80° C. while stirring in a nitrogen stream. To the mixture was added 10 ml of n-propanol containing 500 mg of azobisisobutyronitrile to initiate polymerization. After 5-hours of reaction, the reaction mixture was cooled and then poured into 1.5 liters of water. The precipitated solid was filtered, thoroughly washed with water and dried by heating under reduced pressure to obtain 37.9 g of Polymer Coupler (II). Similarly to Synthesis Example 5, the product was a mixture of polymer couplers having degrees of polymerization of from about 100 to about 5,000, with an average degree of polymerization being about 1,000.

Nitrogen analysis revealed that the polymer coupler contained 51.6 wt% of Monomer Coupler (52).

SYNTHESIS EXAMPLES 7 TO 21

Polymer Couplers (III) to (XVII) were synthesized in the same manner as described in Synthesis Example 5, except for using Couplers Monomers (51) to (65) and various non-color forming monomers as shown in Table 1.

TABLE 1

| Synthesis Example No. | Polymer Coupler | Coupler Unit Monomer Kind | Coupler Unit Monomer Amount** (g) | Non-Color Forming Monomer Kind* | Non-Color Forming Monomer Amount** (g) | Coupler Unit Content in Polymer Coupler (wt %) |
|---|---|---|---|---|---|---|
| 7 | III | (51) | 20 | BA | 40 | 33.6 |

TABLE 1-continued

| Synthesis Example No. | Polymer Coupler | Coupler Unit Monomer Kind | Coupler Unit Monomer Amount** (g) | Non-Color Forming Monomer Kind* | Non-Color Forming Monomer Amount** (g) | Coupler Unit Content in Polymer Coupler (wt %) |
|---|---|---|---|---|---|---|
| 8 | IV | (52) | 20 | MA | 16 | 51.9 |
| | | | | MAA | 4 | |
| 9 | V | (53) | 20 | BMA | 15 | 59.1 |
| 10 | VI | (54) | 20 | BA | 40 | 32 8 |
| 11 | VII | (55) | 20 | MA | 40 | 34.1 |
| 12 | VIII | (55) | 20 | BA | 10 | 67.9 |
| 13 | IX | (56) | 20 | t-BA | 20 | 50.5 |
| 14 | X | (58) | 20 | BA | 15 | 60.3 |
| 15 | XI | (58) | 20 | BA | 30 | 40.6 |
| 16 | XII | (59) | 20 | MA | 8 | 70.1 |
| | | | | AA | 2 | |
| 17 | XIII | (61) | 20 | BA | 40 | 33.3 |
| 18 | XIV | (62) | 20 | EEA | 10 | 50.6 |
| | | | | DAAM | 10 | |
| 19 | XV | (63) | 20 | BA | 20 | 51.0 |
| 20 | XVI | (64) | 20 | MA | 80 | 22.6 |
| 21 | XVII | (65) | 20 | BA | 20 | 51.8 |

Note:
*Abbreviations used in Table 1 have the following meanings:
MA: methyl acrylate
BA: n-butyl acrylate
t-BA: t-butyl acrylate
BMA: butyl methacrylate
EEA: ethoxyethyl acrylate
AA: acrylic acid
MAA: methacrylic acid
DAAM: diacetoneacrylamide
**"Amount" refers to the quantity of monomer charged.

The cyan coupler according to the present invention is contained in a silver halide emulsion layer which constitutes a light-sensitive layer usually in an amount of from 0.002 to 1.0 mol, and preferably from 0.005 to 0.3 mol, per mol of silver halide.

Incorporation of the cyan coupler of the present invention in a light-sensitive material can be effected by various known techniques. It is usually conducted by an oil-in-water dispersion process known as an oil protection process. For example, the coupler is dissolved in an high boiling organic solvent, such as a phthalic ester, e.g., dibutyl phthalate, dioctyl phthalate, etc., and a phosphoric ester, e.g., tricresyl phosphate, trinonyl phosphate, etc., a low boiling organic solvent, such as ethyl acetate, or a mixture thereof, and the resulting solution is emulsified and dispersed in a gelatin aqueous solution containing a surface active agent. Alternatively, water or a gelatin aqueous solution may be added to a coupler solution containing a surface active agent to form an oil-in-water dispersion through phase transition. Further, alkali-soluble couplers may be dispersed by the so-called Fischer's dispersion method. Before mixing with a photographic emulsion, the low boiling organic solvent may be removed from the resulting coupler dispersion by distillation, noodle washing, ultrafiltration, or the like.

Various silver halides can be used in the silver halide emulsion layers according to the present invention. Useful silver halides include silver chloride, silver bromide, silver chlorobromide, silver iodobromide and silver chloroiodide. The preferred are silver iodobromide containing from 2 to 20 mol% of silver iodide and silver chlorobromide containing from 10 to 50 mol% of silver bromide. The crystal form, crystal structure, grain size and grain size distribution of the silver halide grains are not particularly restricted. The silver halide grains may be normal crystals or twins, of may be any of a hexahedron, an octahedron and a tetradecahedron. They may also be plate grains having a mean aspect ratio of not less than 5 with a thickness of not greater than 0.5 μm and a diameter of at least 0.6 μm.

The silver halide crystals may have a homogeneous structure, a structure having different compositions between the inner portion (core) and the outer portion (outer shell), or a layered structure. The silver halide crystals may be those comprising silver halide crystals to which crystals having different compositions are connected epitaxially. They may be mixtures of grains having various crystal forms. Further, they may be those in which a latent image is predominantly formed on the surface thereof or those in which a latent image is predominantly formed in the interior thereof.

The silver halide grains range from fine grains having a grain size of 0.1 μm or smaller to giant grains with the diameter based on the projected surface area thereof reaching 3 μm. The photographic silver halide emulsion may be either a mono-dispersed emulsion having a narrow grain size distribution or a poly-dispersed emulsion having a broad grain size distribution.

These silver halide grains can be prepared by known methods commonly employed in the art.

The silver halide emulsion can be sensitized by generally employed chemical sensitization, i.e., sulfur sensitization, noble metal sensitization, etc. or a combination thereof. Further, the emulsion can be spectrally sensitized to a desired wavelength region with spectral sensitizing dyes. Sensitizing dyes which can be used to advantage in the present invention include methine dyes, such as cyanine dyes, hemicyanine dyes, rhodacyanine dyes, merocyanine dyes, oxonol dyes, hemioxonal dyes, etc., and styryl dyes. These dyes can be used alone or in combinations.

If desired, the silver halide emulsion layers or other hydrophilic colloid layers may contain a fine silver halide emulsion having substantially no light sensitivity, for example, a silver chloride, silver bromide or silver chlorobromide emulsion having a mean grain size of not greater than 0.20 μm.

The cyan couplers in accordance with the present invention can be used together with magenta couplers and yellow couplers for the production of natural color light-sensitive materials or for the production of black-and-white light-sensitive materials in which these couplers are so selected as to provide a neutral gray color. The cyan couplers of the present invention may be used in combination with up to an equimolar amount of conventionally known cyan couplers.

The cyan couplers that can be used in combination may be either 4-equivalent or 2-equivalent to silver ions. Colored couplers having a color correction effect or so-called DIR (development inhibitor releasing) couplers that release a development restrainer with development may also be used in combination.

In addition to DIR couplers, colorless DIR coupling compounds which yield colorless reaction products release development restrainers may also be added.

In the photographic emulsion layers of the present invention, various color forming couplers, that is, compounds capable of forming colors by oxidative coupling with an oxidation product of aromatic primary amine developing agents, may be used. Useful color couplers are cyan couplers, such as naphthol compounds and phenol compounds; magenta couplers, such as pyrazolone compounds and pyrazolo-azole compounds; and yellow couplers, such as open-chain or heterocyclic ketomethylene compounds. Specific examples of the cyan, magenta and yellow couplers are described in patents cited in *Research Disclosure* (RD)-17643, VII-D (December, 1978) and ibid., (RD)-18718 (November, 1979).

It is preferable that the color couplers to be incorporated in the light-sensitive materials have a ballast group or have a polymerized form and are thereby rendered antidiffusible. Two-equivalent color couplers wherein the coupling active position is substituted with a releasable group can attain high sensitivity with a lower silver coverage than four-equivalent color couplers wherein the coupling active position is substituted with a hydrogen atom. Couplers that form colors having moderate diffusibility, colorless couplers, or DIR couplers capable of releasing development restrainers or development accelerators upon coupling reaction may also be used.

The yellow couplers which can be used in the present invention typically include acylacetamide couplers of the oil protection type. Specific examples thereof are described in U.S. Pat. Nos. 2,407,210, 2,875,057 and 3,265,506. In the present invention, use of two-equivalent yellow couplers is preferred. Typical examples of such two-equivalent yellow couplers are oxygen atom-releasing type yellow couplers as described in U.S. Pat. Nos. 3,408,194, 3,447,928, 3,933,501 and 4,022,620; and nitrogen atom-releasing yellow couplers as described in Japanese Patent Publication No. 10739/83, U.S. Pat. Nos. 4,401,752 and 4,326,024, *Research Disclosure*, RD-18053 (April, 1979), British Pat. No. 1,425,020, West German Patent Application (OLS) Nos. 2,219,917, 2,261,361, 2,329,587 and 2,433,812, etc. α-Pivaloylacetanilide couplers are excellent in fastness of developed colors, especially fastness to light. Further, α-benzoylacetanilide couplers can provide high color density.

The magenta couplers which can be used in this invention typically include oil protection type indazolone or cyanoacetyl couplers, and preferably pyrazolo-azole couplers, e.g., 5-pyrazolones and pyrazolotriazoles. 5-Pyrazolone couplers having their 3-position substituted with an arylamino group or an acylamino group are preferred from the standpoint of hue or density of formed colors. Typical examples of such 5-pyrazolone couplers are described, e.g., in U.S. Pat. Nos. 2,311,082, 2,343,703, 2,600,788, 2,908,573, 3,062,653, 3,152,896 and 3,936,015, etc. Particularly preferred releasable groups for the 2-equivalent 5-pyrazolone couplers are a nitrogen atom-releasable group as described in U.S. Pat. No. 4,310,619 and an arylthio group as described in U.S. Pat. No. 4,351,897. 5-Pyrazolone couplers having a ballast group, as described in EPC No. 73,636, provide a high color density.

The pyrazolo-azole couplers include pyrazolobenzimidazoles described in U.S. Pat. No. 3,369,879, and preferably pyrazolo[5,1-c][1,2,4]triazoles described in U.S. Pat. No. 3,725,067, pyrazolotetrazoles described in *Research Disclosure* RD No. 24220 (June, 1984) and pyrazolopyrazoles described in Research Disclosure RD No. 24230 (June, 1984). In view of small side absorption of yellow and excellent light-fastness of the formed dye, imidazo[1,2-b]pyrazoles described in EPC No. 119,741 are preferred, and pyrazolo[1,5-b][1,2,4]triazoles described in EPC No. 119,860 are particularly preferred.

Cyan couplers which can be used together with the cyan coupler used according to the present invention include oil protection type naphthol and phenol couplers. Typical examples of the naphthol couplers are those described in U.S. Pat. No. 2,474,293, and preferably 2-equivalent naphthol couplers of oxygen atom releasing type as disclosed in U.S. Pat. Nos. 4,052,212, 4,146,396, 4,228,233 and 4,296,200. Specific examples of the phenol couplers are described in U.S. Pat. Nos. 2,369,929, 2,801,171, 2,772,162 and 2,895,836. Cyan couplers showing fastness to humidity and temperature are preferably used in the present invention. Typical examples of such cyan couplers are phenol cyan couplers described in U.S. Pat. No. 3,772,002; 2,5-diacylamino-substituted phenol couplers described in U.S. Pat. Nos. 2,772,162, 3,758,308, 4,126,396, 4,334,011 and 4,327,173, West German Patent Application (OLS) No. 3,329,729 and Japanese Patent Application No. 42671/83; phenol couplers having a phenylureido group at the 2-position thereof and an acylamino group at the 5-position thereof as described in U.S. Pat. Nos. 3,446,622, 4,333,999, 4,451,559 and 4,427,767; and the like.

In order to correct unnecessary absorption in the shorter wavelength region shown by the dyes formed by magenta and cyan couplers, it is preferable that color light-sensitive materials for photographing contain colored couplers. Typical examples of colored couplers include yellow colored magenta couplers as disclosed in U.S. Pat. No. 4,163,670 and Japanese Patent Publication No. 39413/82 and magenta colored cyan couplers as disclosed in U.S. Pat. Nos. 4,004,929 and 4,138,258 and British Pat. No. 1,146,368.

Graininess can be improved by using color forming couplers which yield dyes having moderate diffusibility. Specific examples of such couplers are described in U.S. Pat. No. 4,366,237 and British Pat. No. 2,125,570 as to magenta couplers, and EPC No. 96,570 and West German Patent Publication (OLS) No. 3,234,533 as to yellow, magenta and cyan couplers.

The color forming couplers and the above-described special couplers may be polymerized to form dimers or high polymers. Typical examples of yellow polymeric couplers are described in U.S. Pat. Nos. 3,451,820 and 4,080,211. Examples of polymeric magenta couplers are described in British Pat. No. 2,102,173 and U.S. Pat. No. 4,367,282.

The light-sensitive materials accordingto the present invention can contain two or more of these various couplers in the same light-sensitive layer thereof, or can contain the same coupler in two or more light-sensitive layers thereof in order to meet characteristic requirements of the materials.

The color couplers are generally used in an amount of from 0.001 to 1 mol per mol of the light-sensitive silver halide. Preferably, the yellow coupler is used in an amount of from 0.01 to 0.5 mol; the magenta coupler is used in an amount of from about 0.003 to 0.3 mol; and the cyan coupler according to the present invention and other cyan couplers used in combination, if any, are used in a total amount of from 0.005 to 0.3 mol; each per mol of the silver halide.

Supports that can be used in the present invention may be any of transparent supports, such as a polyethylene terephthalate film and a cellulose triacetate film, and reflective supports. The reflective supports include baryta paper, polyethylene-laminated paper, polypropylene type synthetic paper, and transparent supports (e.g., a glass plate, polyester films, e.g., polyethylene terephthalate, cellulose triacetate and nitrocellulose, a polyamide film, a polycarbonate film, a polystyrene film, etc.) which has provided thereon a reflective layer or which is used in combination with a reflector. These supports can appropriately be selected according to the end use.

The color photographic light-sensitive material according to the present invention may further comprise an auxiliary layer, such as a subbing layer, an intermediate layer, a protective layer, etc., in addition to the silver halide emulsion layer. If desired, an ultraviolet absorbing layer may be provided at a position farther from the support than the emulsion layer or between a red-sensitive silver halide emulsion layer and a green-sensitive silver halide emulsion layer.

Gelatins can be advantageously used as a binder or protective colloid for photographic emulsion, but other hydrophilic colloids may also be employed. The gelatins that can be used include lime-processed gelatin as well as acid-processed gelatin and enzyme-processed gelatin as described in *Bull. Soc. Sci. Phot. Japan,* No. 16, 30 (1966). Hydrolysis products or enzymatic decomposition products of gelatin may also be used.

The photographic emulsion layers or other hydrophilic colloidal layers of the light-sensitive materials of the present invention can contain fluorescent brightening agents of stilbene type, triazine type, oxazole type or coumarin type. These brightening agents may either be water-soluble or water-insoluble. In the latter case, the agents may be used in the form of a dispersion. Specific examples of usable fluorescent brightening agents are described in U.S. Pat. Nos. 2,632,701, 3,269,840 and 3,359,102, British Pat. Nos. 852,075 and 1,319,763, *Research Disclosure,* Vol. 176, RD No. 17643, page 24, left column, lines 9–36, "Brighteners" (December, 1978).

When the hydrophilic colloidal layers contain dyes or ultraviolet absorbers, these compounds can be fixed thereto by cationic polymer mordants or the like.

The color photographic light-sensitive materials according to the present invention can contain color fog preventing agents, such as hydroquinone derivatives, aminophenol derivatives, gallic acid derivatives, ascorbic acid derivatives, and the like, with specific examples thereof being described, e.g., in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77, Japanese Patent Publication No. 23813/75, etc.

The light-sensitive materials according to the present invention may further contain, if desired, other various photographic additives known in the art, such as stabilizers, antifoggants, surface active agents, couplers other than those specified in the present invention, filter dyes, dyes for preventing irradiation, developing agents, and the like. Typical examples of these additives are described in *Research Disclosure,* RD No. 17643 (December, 1978).

Color developing solutions which can preferably be used in the present invention are alkaline aqueous solutions comprising an aromatic primary amine color developing agent as a main component. The color developing agent include aminophenol compounds and, preferably, p-phenylenediamine compounds. Typical examples of the latter compounds are 3-methyl-4-amino-N,N-diethylaniline, 3-methyl-4-amino-N,N-β-hydroxylethylaniline, 3-methyl-4-amino-N-ethyl-N-β-methanesulfonamidoethylaniline, 3-methyl-4-amino-N-ethyl-N-β-methoxyethylaniline and sulfates, hydrochlorides or p-toluenesulfonates thereof. Salts of these diamines, which are generally more stable than free forma, are preferred.

The color developing solution generally contains a pH buffer, e.g., alkali metal carbonates, borates or phosphates, etc., and a development restrainer or antifoggant, e.g., bromides, iodides, benzimidazoles, benzothiazoles or mercapto compounds, etc. The developing solution may further contain, if necessary, a preservative, e.g., hydroxylamine and sulfites; an organic solvent, e.g., triethanolamine and diethylene glycol; a development accelerator, e.g., benzyl alcohol, polyethylene glycol, quaternary ammonium salts and amines; a color forming coupler; a competing coupler; a nucleating agent, e.g., sodium boron hydride; an auxiliary developing agent, e.g., 1-phenyl-3-pyrazolidone; a viscosity-imparting agent; a wide variety of chelating agents, e.g., aminopolycarboxylic acids, aminopolyphosphonic acids, alkylphosphonic acids, phosphonocarboxylic acids, etc.; an antioxidant, e.g., those described in West German Publication (OLS) No. 2,622,950; and the like.

Development processing of reversal color light-sensitive materials is generally carried out by black-and-white development, followed by color development. The black-and-white developing solution that can be used contains a known black-and-white developing agent, such as dihydroxybenzenes, e.g., hydroquinone, 3-pyrazolidones, e.g., 1-phenyl-3-pyrazolidone, and aminophenols, e.g., N-methyl-p-aminophenol, and the like, either alone or in combination thereof.

After the color development, the photographic emulsion layer is generally subjected to bleaching. The bleaching may be effected simultaneously with fixing, or these two processings may be carried out separately. Bleaching agents that can be used include, for example, compounds of polyvalent metals, e.g., iron (III), cobalt (III), chromium (IV), copper (II), etc., peracids, quinones, nitroso compounds, and the like. Typical examples of these bleaching agents are ferricyanides; bichromates; organic complex salts formed by iron (III) or cobalt (III) and aminopolycarboxylic acids, e.g., ethylenediaminetetraacetic acid, diethylenetriaminepentaacetic acid, nitrilotriacetic acid, 1,3-diamino-2-propanoltetraacetic acid, etc., or organic acids, e.g., citric acid, tartaric acid, malic acid, etc.; persulfates; permanganates; nitrosophenol; and the like. Of these, (ethylenediaminetetraacetate) iron (III) salts and persulfates are preferred from the standpoint of rapid processing and prevention of environmental pollution. (Ethylenediaminetetracetato) iron (III) complex salts are particularly useful in both of an independent bleaching bath and a combined bleach-fix bath.

The bleaching or beach-fix bath can contain various bleach accelerating agents, if desired. Examples of the accelerators include bromides, iodides as well as thiourea compounds as shown in U.S. Pat. No. 3,706,561, Japanese Patent Publication Nos. 8506/70 and 26586/74 and Japanese Patent Application (OPI) Nos. 32735/78, 36233/78 and 37016/78; thiol compounds as shown in Japanese Patent Application (OPI) Nos. 124424/78, 95631/78, 57831/78, 32736/78, 65732/78 and 52534/79, U.S. Pat. No. 3,893,858, etc.; heterocyclic compounds as described in Japanese Patent Application (OPI) Nos. 59644/74, 140129/75, 28426/78, 141623/78, 104232/78 and 35727/79, etc.; thioether compounds as described in Japanese Patent Application (OPI) Nos. 20832/77, 25064/80 and 26506/80, etc.; tertiary amines as described in Japanses Patent Application (OPI) No. 84440/73; thiocarbamoyls as described in Japanese Patent Application (OPI) No. 42349/74; and the like, either alone or in combinations of two or more thereof. Among them, bromides, iodides, thiol compounds and disulfide compounds are preferred. These bleach accelerating agents are particularly useful in the bleach-fixing of color light-sensitive materials for photography.

The fixing agent that can be used includes thiosulfates, thiocyanates, thioether compounds, thioureas and a large quantity of iodides, with thiosulfates being generally employed. Preferred preservatives for the bleach-fix bath or fixer are sulfites, bisulfites and carbonyl bisulfite adducts.

The bleach-fix or fixing is usually followed by washing. Various known compounds can be used for the washing for the purpose of preventing precipitation or saving water. For example, for the purpose of preventing precipitation, water softeners, such as inorganic phosphoric acids, aminopolycarboxylic acids, organic phosphoric acids, etc., bacteriocides for preventing generation of various bacteria, algae and molds, hardeners, such as magnesium salts and aluminum salts, and surface active agents for reducing load during drying or preventing uneven drying can be added to washing water, if desired. The compounds described in L. E. West, "Water Quality Criteria", *Phot. Sci. Eng.*, Vol. 6, 344–359 (1965) can also be added. Addition of chelating agents or bactericides is particularly effective.

The washing is generally carried out by a counter-current system using at least two baths for the purpose of saving water. A multi-stage counter-current stabilization processing as described in Japanese Patent Application (OPI) No. 8543/82 may be effected in place of the washing. In this case, 2 to 9 counter-current baths are required. The stabilizing baths can contain various compounds for stabilizing images, such as a combination of various buffers for film pH-adjustment (to a pH, e.g., of 3 to 8) (e.g., borates, metaborates, borax, phosphates, carbonates, potassium hydroxide, sodium hydroxide, aqueous ammonia, monocarboxylic acids, discarboxylic acids, polycarboxylic acids, etc.) and formalin can be added. In addition, the stabilizing bath can contain, if desired, various other additives, such as water softeners (e.g., inorganic phosphates, aminopolycarboxylic acids, organic phosphates, aminopolyphosphoric acids, phosphonocarboxylic acids, etc.), bactericides (e.g., benzoisothiazolinone, isothiazolone, 4-thiazolinebenzimidazole, a halogenated phenol, etc.), surface active agents, fluorescent brightening agents, hardeners, and the like. Two or more of these compounds being for the same or different purposes may be used in combination.

Further, various ammonium salts, such as ammonium chloride, ammonium nitrate, ammonium sulfate, ammonium phosphate, ammonium sulfite, ammonium thiosulfate, etc., can preferably be added as a film pH-adjusting agent after processing.

For the purpose of achieving simplified and rapid processing, the color developing agent may be incorporated in the silver halide color light-sensitive materials according to the present invention. Incorporation of color developing agents in the light-sensitive materials can preferably be effected by using various precursors thereof, for example, indoaniline compounds as disclosed in U.S. Pat. No. 3,342,597, Schiff base compounds as disclosed in U.S. Pat. No. 3,342,599 and *Research Disclosure,* Nos. 14850 and 15159, aldol compounds as described in *Research Disclosure,* No. 13924, metal salt complexes as described in U.S. Pat. No. 3,719,492, urethane compounds as described in Japanese Patent Application (OPI) No. 135628/75, and various salt type precursors as described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82 and 83565/82, etc.

The silver halide color light-sensitive materials according to the present invention may contain, if desired, various 1-phenyl-3-pyrazolidones for the purpose of accelerating color development. Typical examples of the 1-phenyl-3-pyrazolidones are shown, e.g., in 64339/81, 144547/82, 211147/82, 50532/83, 50536/83, 50533/83, 50534/83, 50535/83 and 115438/83, etc.

Each of the processing solutions in accordance with the present invention is used at a temperature of from 10° to 50° C., and generally at 33° to 38° C. It is possible to employ higher temperatures, to thereby accelerate the processing and to shorten the processing time, or to employ lower temperatures to thereby improve image quality or stability of the processing solution. In addition, intensification using cobalt or hydrogen peroxide as disclosed in West German Pat. No. 2,226,770 or U.S. Pat. No. 3,674,499, respectively, may be carried out for the purpose of saving silver.

The present invention is illustrated hereinafter in greater detail with reference to examples, but it should be understood that the present invention is not limited thereto. In these Examples, all percents are by weight unless otherwise indicated.

EXAMPLE 1

Ten grams of Coupler (1), 10 g of trioctyl phosphate and 20 ml of ethyl acetate were heated at 50° C. The resulting solution was added to 100 ml of an aqueous solution containing 10 g gelatin and 0.4 g of dodecylbenzenesulfonic acid, followed by stirring. The mixture was finely emulsified and dispersed by passing it through a colloid mill five times.

The whole quantity of the resulting emulsion was added to 400 g of a photographic emulsion containing 28 g of silver iodobromide and 30 g of gelatin, and 30 ml of a 2% aqueous solution of 4,6-dichloro-2-hydroxytriazine was added thereto as a hardener. After pH-adjustment to a pH of 6.0, the resulting mixture was uniformly coated on a cellulose triacetate film base. The resulting sample was designated as Sample 1A.

Samples 1B and 1C were prepared in the same manner as described above except that Coupler (1) was replaced by the equimole of Couplers (3) and (6), respectively.

For comparison, Samples 1D, 1E and 1F were prepared in the same manner as described above except that Coupler (1) was replaced by an equimolar amount of Comparative Couplers (101), (102) and (103), respectively.

Comparative Couplers (101)

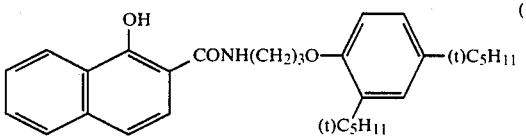

(102)

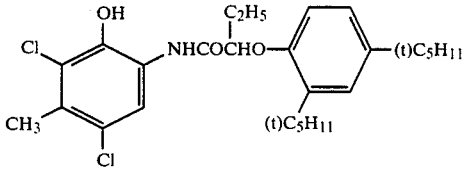

(103)

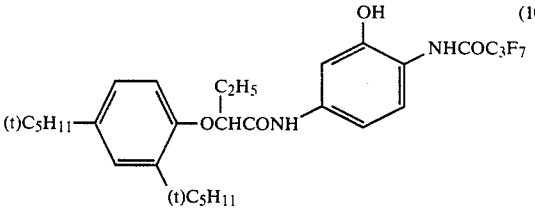

Each of the resulting samples was exposed to light and development-processed as follows:

Color Development Process (38° C.):

1. Color development: 3'15"
2. Bleaching: 6'30"
3. Washing: 3'15"
4. Fixing: 6'30"
5. Washing: 3'15"
6. Stabilization: 3'15"

The processing solution used in each step had the following composition:

Color Developing Solution:
Sodium nitrotriacetate: 1.0 g
Sodium sulfite: 4.0 g
Sodium carbonate: 30.0 g
Potassium bromide: 1.4 g
Hydroxylamine sulfate: 2.4 g
4-(N-Ethyl-N-β-hydroxyethylamino)-2-methylaniline sulfate: 4.5 g
Water to make: 1 liter Bleaching Solution:
Ammonium bromide: 160 g
Aqueous ammonia (28%): 25.0 ml
Sodium (ethylenediaminetetraacetato)ferrate: 130 g
Glacial acetic acid: 14 ml
Water to make: 1 liter Fixing Solution:
Sodium tetrapolyphosphoric acid: 2.0 g
Sodium sulfite: 4.0 g
Ammonium thiosulfate (70%): 175 ml
Sodium bisulfite: 4.6 g
Water to make: 1 liter Stabilizing Solution:
Formalin (37% formaldehyde solution): 8.0 ml
Water to make: 1 liter The samples thus processed were subjected to tests of color fastness as follows. Each sample was allowed to stand at 100° C. in the dark for 8 days, or exposed to light for 8 days using a xenon tester (100,000 lux), and the fastness of the image was expressed in terms of percent reduction of density at the area having the initial density of 1.0. The results obtained are shown in Table 1.

TABLE 1

| Sample No. | Coupler | Percent Reduction of Density 100° C., 8 Days (%) | Light, 8 Days (%) |
|---|---|---|---|
| 1A | (1) (Invention) | 8 | 12 |
| 1B | (3) (Invention) | 5 | 10 |
| 1C | (5) (Invention) | 6 | 11 |
| 1D | (101) (Comparison) | 39 | 29 |
| 1E | (102) (Comparison) | 75 | 45 |
| 1F | (103) (Comparison) | 10 | 47 |

It can be seen from the results of Table 1 that the cyan couplers according to the present invention form dye images having excellent fastness to both heat and light.

EXAMPLE 2

Onto a cellulose triacetate film support were coated the following layers in the order listed to prepare a multilayer color light-sensitive material.

First Layer: Antihalation Layer
A gelatin layer containing black colloidal silver.

Second Layer: Intermediate Layer
A gelatin layer containing an emulsified dispersion of 2,5-di-t-octylhydroquinone.

Third Layer: First Red-Sensitive Emulsion Layer
Silver iodobromide emulsion (silver iodide content: 5 mol%): 1.6 g/m$^2$ as Ag
Sensitizing Dye I: $4.5\times10^{-4}$ mol per mol of Ag
Sensitizing Dye II: $1.5\times10^{-4}$ mol per mol of Ag
Coupler (104): 0.04 mol per mol of Ag
Coupler EX-1: 0.003 mol per mol of Ag
Coupler EX-7: 0.0006 mol per mol of Ag Fourth Layer: Second Red-Sensitive Emulsion Layer
Silver iodobromide emulsion (silver iodide content: 10 mol%): 1.4 g/m$^2$ as Ag
Sensitizing Dye I: $3\times10^{-4}$ mol per mol of Ag
Sensitizing Dye II: $1\times10^{-4}$ mol per mol of Ag
Coupler (21): 0.022 mol per mol of Ag
Coupler EX-1: 0.0016 mol per mol of Ag Fifth Layer: Intermediate Layer
The same as the second layer.

Sixth Layer: First Green-Sensitive Emulsion Layer
Silver iodobromide emulsion (silver iodide content: 4 mol%): 1.2 g/m$^2$ as Ag
Sensitizing Dye III: $5\times10^{-4}$ mol per mol of Ag
Sensitizing Dye IV: $2\times10^{-4}$ mol per mol of Ag
Coupler EX-2: 0.05 mol per mol of Ag
Coupler EX-3: 0.008 mol per mol of Ag
Coupler EX-7: 0.0015 mol per mol of Ag Seventh Layer: Second Green-Sensitive Emulsion Layer Silver iodobromide emulsion (silver iodide content: 8 mol%): 1.3 g/m$^2$ as Ag
Sensitizing Dye III: $3\times10^{-4}$ mol per mol of Ag
Sensitizing Dye IV: $1.2\times10^{-4}$ mol per mol of Ag
Coupler EX-5: 0.017 mol per mol of Ag
Coupler EX-4: 0.003 mol per mol of Ag
Coupler EX-8: 0.0003 mol per mol of Ag Eighth Layer: Yellow Filter Layer A gelatin layer comprising a gelatin aqueous solution containing yellow colloidal silver and a dispersion of 2,5-di-t-octylhydroquinone.

Ninth Layer: First Blue-Sensitive Emulsion Layer

Silver iodobromide emulsion (silver iodide content: 6 mol%): 0.7 g/m$^2$ as Ag
Coupler EX-6: 0.25 mol per mol of Ag
Coupler EX-7: 0.015 mol per mol of Ag Tenth Layer: Second Blue-Sensitive Emulsion Layer Silver iodobromide emulsion (silver iodide content: 6 mol%): 0.6 g/m$^2$ as Ag
Coupler EX-6: 0.06 mol per mol of Ag Eleventh Layer: First Protective Layer Silver iodobromide emulsion (silver iodide content: 1 mol%; mean grain size: 0.07 μm): 0.5 g/m$^2$ as Ag A gelatin layer containing as emulsified dispersion of Ultraviolet Absorbent UV-1.

Twelfth Layer: Second Protective Layer

A gelatin layer containing polymethyl methacrylate particles (diameter: ca. 1.5 μm).

Each of the above-described layers additionally contained Gelatin Hardener H-1 and a surface active agent. The thus prepared sample was designated as Sample 2A.

Sample 2B was prepared in the same manner as described above except for replacing Coupler (104) by the equimole of Coupler (8).

For comparison, Sample 2C was prepared in the same manner as above except for replacing Coupler (104) by the equimole of Coupler (105).

Compounds used for the preparation of these samples are as follows:

Coupler EX-1:

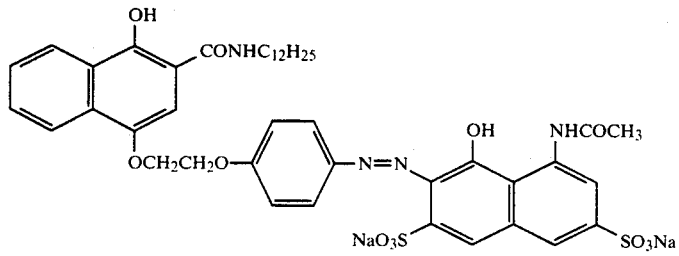

Coupler EX-2:

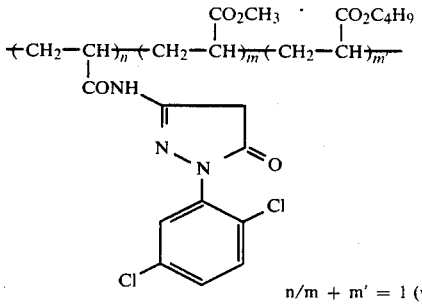

n/m + m' = 1 (weight ratio)
m/m' = 1 (weight ratio)
M.W. = Ca. 4,000

Coupler EX-3:

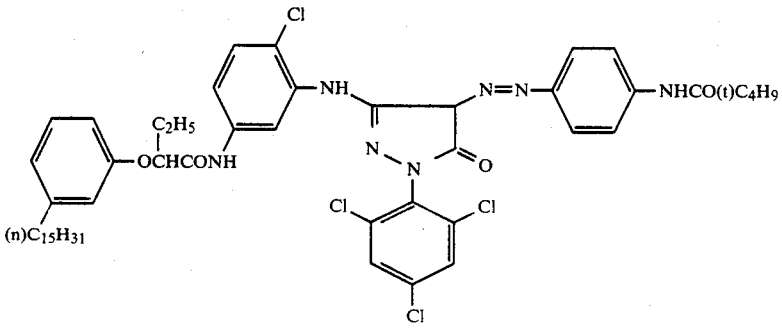

Coupler EX-4:

-continued
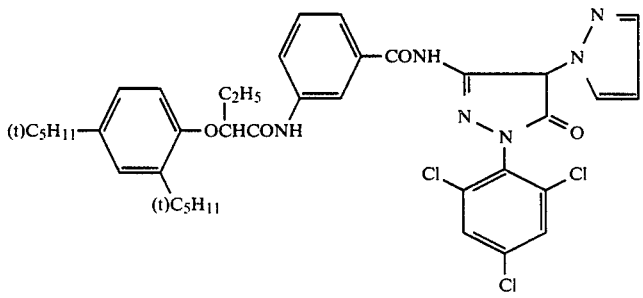
Coupler EX-5:
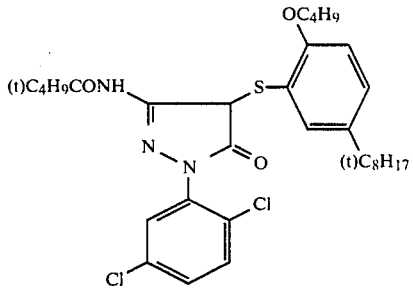
Coupler EX-6:
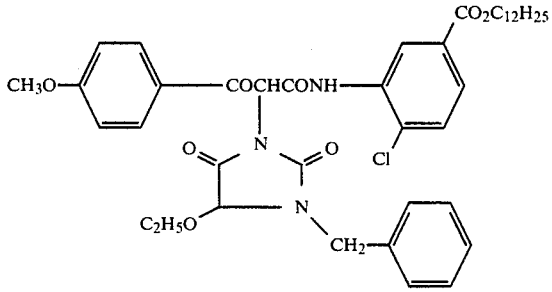
Coupler EX-7:
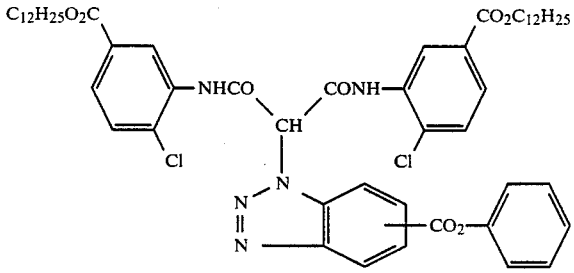
Coupler EX-8:
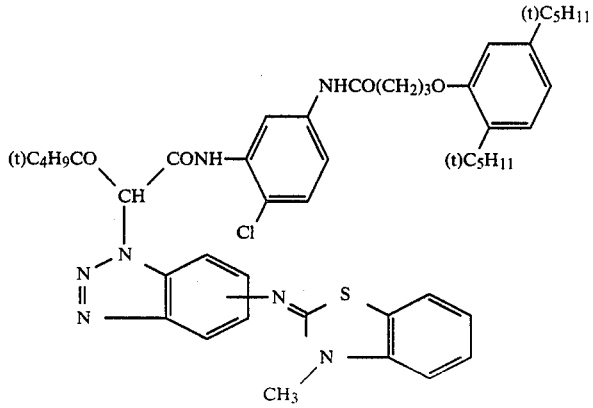

-continued
Gelatin Hardener H-1:
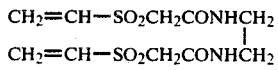
Ultraviolet Absorbent UV-1:
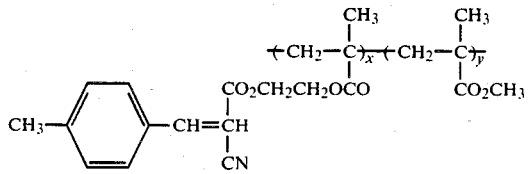
x/y = 7/3 (weight ratio)
Sensitizing Dye I:
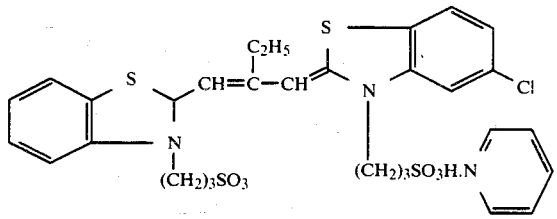
Sensitizing Dye II:
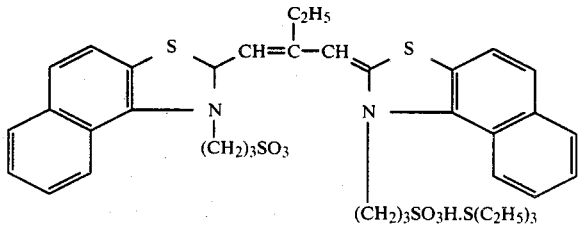
Sensitizing Dye III:
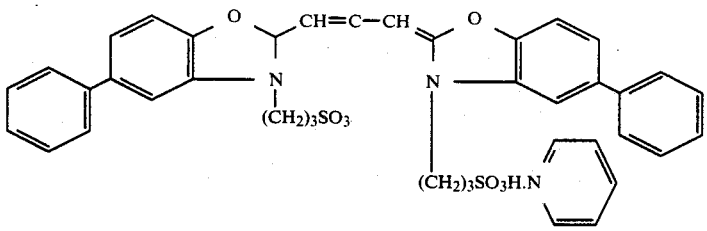
Sensitizing Dye IV:
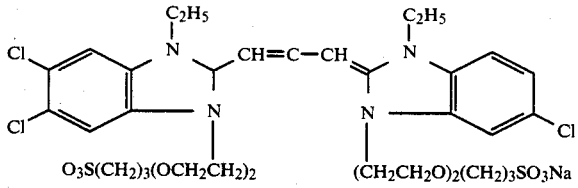
Comparative Coupler (104):
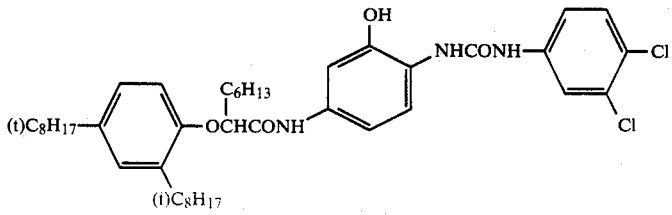
Comparative Coupler (105):

-continued

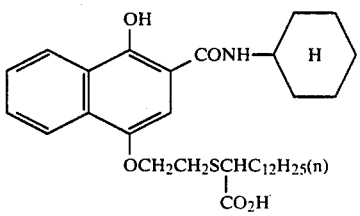

Each of the resulting samples was exposed and developed in the same manner as described in Example 1.

The thus processed sample was allowed to stand in the dark at 100° C. for 8 days or allowed to stand in the dark at 60° C. and 70% RH (relative humidity) for 4 weeks. The fastness of the dye image was evaluated in terms of the percent reduction of density at the area having an initial density of 1.0. The results obtained are shown in Table 2.

TABLE 2

| Sample No. | Coupler 3rd Layer | Coupler 4th Layer | Percent Reduction of Density 100° C. 8 Days (%) | Percent Reduction of Density 60° C., 70% RH 4 Weeks (%) | Remark |
|---|---|---|---|---|---|
| 2A | (104) | (21) | 5 | 1 | Invention |
| 2B | (8) | (21) | 4 | 2 | Invention |
| 2C | (101) | (105) | 34 | 12 | Comparison |

It can be seen from the results of Table 2 that the dye images formed by the cyan couplers according to the present invention exhibit excellent fastness to heat and humidity.

EXAMPLE 3

Onto a cellulose triacetate film support were coated the following layers in the order listed to prepare Sample 3A.

First Layer: Red-Sensitive Emulsion Layer

Silver iodobromide emulsion (silver iodide content: 5 mol%; mean grain size: 0.4 μm): 1.79 g/m$^2$ as Ag Sensitizing Dye V: $4.5\times10^{-4}$ mol per mol of Ag Sensitizing Dye VI: $1.5\times10^{-4}$ mol per mol of Ag Coupler EX-9: 0.06 mol per mol of Ag Second Layer: Protective Layer A gelatin layer containing polymethyl methacrylate particles (diameter: ca. 1.5 μm).

Each of the above-described layers further contained Gelatin Hardener H-1 and a surface active agent.

Samples 3B to 3E were prepared in the same manner as described above except for replacing Coupler EX-9 by equimolar amounts of Coupler EX-10, Coupler (23) and Coupler (30), respectively.

Compounds used for the preparation of these samples were as follows:

Sensitizing Dye V: Anhydro-5,5'-dichloro-3,3'-di-(γ-sulfopropyl)-9-ethyl-thiacarbocyanine hydroxide pyridinium salt.

Sensitizing Dye VI: Anhydro-9-ethyl-3,3'-di-(γ-sulfopropyl)-4,5,4',5'-dibenzothiacarbocyanine hydroxide triethylamine salt.

Coupler EX-9

-continued

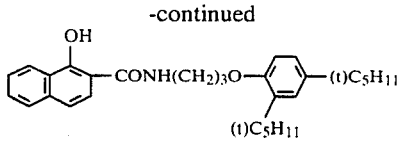

Coupler EX-10

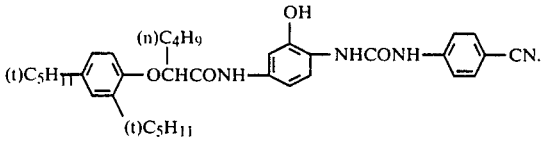

Each of the samples was sensitometerically exposed and developed in the same manner as described in Example 1 (Process A).

The same procedures as described above were repeated except that the exposed sample was developed using the following bleaching solution (Process B). The bleaching solution used in Process B approximated a fatigued bleaching solution, i.e., a bleaching solution after having been used for processing of a large quantity of light-sensitive materials.

Composition of Bleaching Solution:

(D-1)

Ammonium bromide: 160.0 g

Aqueous ammonia (28%): 7.1 ml

Sodium(ethylenediaminetetraacetato)ferrate (III): 117 g

Glacial acetic acid: 14 ml

Water to make: 900 ml (D-2)

Sodium(ethylenediaminetetraacetato)ferrate (III): 130 g

Water to make: 1 liter

Steel wool was poured into (D-2), and the mixture was sealed and allowed to stand to thereby convert (ethylenediaminetetraacetato)Fe (III) to (ethylenediaminetetraacetato)Fe (II). A 100 ml portion of the resulting mixture was added to (D-1) to prepare a bleaching solution for Process B.

The density of each of the thus processed samples was measured using red light, and the results obtained are shown in Table 3.

TABLE 3

| Sample No. | Coupler | Maximum Density Process A (Dm. A) | Maximum Density Process B (Dm. B) | Dm. B/ Dm. A | Remark |
|---|---|---|---|---|---|
| 3A | EX-9 | 1.68 | 1.20 | 0.61 | Comparison |
| 3B | EX-10 | 1.79 | 1.77 | 0.99 | Comparison |
| 3C | (23) | 1.35 | 1.34 | 0.99 | Invention |
| 3D | (28) | 1.57 | 1.57 | 1.00 | Invention |
| 3E | (30) | 1.62 | 1.60 | 0.99 | Invention |

It can be seen from Table 1 that Sample 3A wherein Coupler EX-9 was used undergoes serious reduction in color density when processed with a fatigued bleaching solution, whereas such reduction in color density is scarcely noted in Samples 3B to 3E wherein Coupler EX-10 and Couplers (23), (28) and (30) according to the present invention were used.

Further, Samples 3A to 3E processed according to Process A were examined for variation of spectral absorption of the dye image depending on density. As a result, Sample 3B showed conspicuous variation of spectral absorption depending on density, while such variation of spectral absorption was not substantially noted in Samples 3A and 3C to 3E.

From these results, it is apparent that the cyan couplers according to the present invention can form dye images that undergo substantially no reduction in color density even when processed with a fatigued bleaching solution and also whose spectral absorption is less dependent on color density, and are, therefore, superior to the conventional cyan couplers.

EXAMPLE 4

Samples 4A to 4C were prepared in the same manner as described in Example 3 except that Coupler EX-9 as used in Sample 3A was replaced by the equimole of Coupler EX-11, Coupler (29) and Coupler (34), respectively.

Coupler EX-11

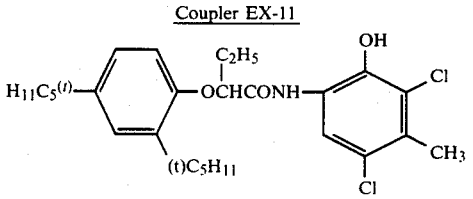

Each of Samples 4A to 4C and Samples 3A, 3D and 3E prepared in Example 3 was exposed for sensitometry and development-processed according to Process A as in Example 3. The thus processed sample was allowed to stand in the dark at 100° C. for 14 days, or exposed to light for 7 days using a xenon tester (100,000 lux) to evaluate fastness of the dye image. The results obtained are shown in Table 4.

TABLE 4

| Sample No. | Coupler | Percent Remaining of Dye Image 100° C., 14 Days (%) | Light, 7 Days (%) | Remark |
|---|---|---|---|---|
| 4A | EX-11 | 10 | 91 | Comparison |
| 3A | EX-9 | 75 | 88 | Comparison |
| 3D | (28) | 99 | 96 | Invention |
| 3E | (30) | 98 | 97 | Invention |
| 4B | (29) | 99 | 96 | Invention |
| 4C | (34) | 99 | 97 | Invention |

It is apparent from Table 4 that the dye images formed by the couplers according to the present invention have superior fastness.

EXAMPLE 5

Onto a cellulose triacetate film support were coated the following layers in the order listed to prepare a multilayer color light-sensitive material. This sample was designated as Sample 5A.

First Layer: Antihalation Layer

A gelatin layer containing black colloidal silver.

Second Layer: Intermediate Layer

A gelatin layer containing an emulsified dispersion of 2,5-di-t-octylhydroquinone.

Third Layer: First Red-Sensitive Emulsion Layer

Silver iodobromide emulsion (silver iodide content: 5 mol%): 1.6 g/m$^2$ as Ag

Sensitizing Dye V: $4.5\times10^{-4}$ mol per mol of Ag

Sensitizing Dye VI: $1.5\times10^{-4}$ mol per mol of Ag

Coupler EX-9: 0.03 mol per mol of Ag

Coupler EX-12: 0.003 mol per mol of Ag

Coupler EX-13: 0.0008 mol per mol of Ag

Fourth Layer: Second Red-Sensitive Emulsion Layer

Silver iodobromide emulsion (silver iodide content: 10 mol%): 1.4 g/m$^2$ as Ag

Sensitizing Dye V: $3\times10^{-4}$ mol per mol of Ag

Sensitizing Dye VI: $1\times10^{-4}$ mol per mol of Ag

Coupler EX-14: 0.005 mol per mol of Ag

Coupler EX-15: 0.017 mol per mol of Ag

Coupler EX-12: 0.0016 mol per mol of Ag

Fifth Layer: Intermediate Layer

The same as the second layer.

Sixth Layer: First Green-Sensitive Emulsion Layer

Silver iodobromide emulsion (silver iodide content: 4 mol%): 1.2 g/m$^2$ as Ag

Sensitizing Dye VII: $5\times10^{-4}$ mol per mol of Ag

Sensitizing Dye VIII: $2\times10^{-4}$ mol per mol of Ag

Coupler EX-16: 0.05 mol per mol of Ag

Coupler EX-17: 0.008 mol per mol of Ag

Coupler EX-18: 0.0018 mol per mol of Ag

Seventh Layer: Second Green-Sensitive Emulsion Layer

Silver iodobromide emulsion: 1.3 g/m$^2$ as Ag

Sensitizing Dye VII: $3\times10^{-4}$ mol per mol of Ag

Sensitizing Dye VIII: $1.2\times10^{-4}$ mol per mol of Ag

Coupler EX-19: 0.017 mol per mol of Ag

Coupler EX-20: 0.003 mol per mol of Ag

Eighth Layer: Yellow Filter Layer

A gelatin layer comprising a gelatin aqueous solution containing yellow colloidal silver and an emulsified dispersion of 2,5-di-t-octylhydroquinone.

Ninth Layer: Firs Blue-Sensitive Emulsion Layer

Silver iodobromide emulsion (silver iodide content: 6 mol%): 0.7 g/m$^2$ as Ag

Coupler EX-21: 0.25 mol per mol of Ag

Coupler EX-22: 0.015 mol per mol of Ag

Tenth Layer: Second Blue-Sensitive Emulsion Layer

Silver iodobromide emulsion (silver iodide content: 6 mol%): 0.6 g/m$^2$ as Ag

Coupler EX-21: 0.06 mol per mol of Ag

Eleventh Layer: First Protective Layer

Silver iodobromide emulsion (silver iodide content: 1 mol%; mean grain size: 0.07 μm): 0.5 g/m$^2$ as Ag A gelatin layer containing an emulsified dispersion of Ultraviolet Absorbent UV-1.

Twelfth Layer: Second Protective Layer

A gelatin layer containing polymethyl methacrylate particles (diameter: 1.5 μm).

Each of the above-described layers additionally contained Gelatin Hardener H-1 and a surface active agent.

Samples 5B and 5C were prepared in the same manner as described above except for displacing Coupler EX-9 as used in the third layer by the equimole of Coupler (28) and Coupler (30), respectively.

Compounds used for the preparation of these samples are as follows.

Sensitizing Dye VII: Anhydro-9-ethyl-5,5'-dichloro-3,3'-di-(γ-sulfopropyl)oxacarbocyanine sodium salt.

Sensitizing Dye VIII: Anhydro-5,6,5',6'-tetrachloro-1,1'-diethyl-3,3'-di β-[β-(γ-sulfopropoxy)ethoxy]ethylimidazolocarbocyanine hydroxide sodium salt.

Coupler EX-12:
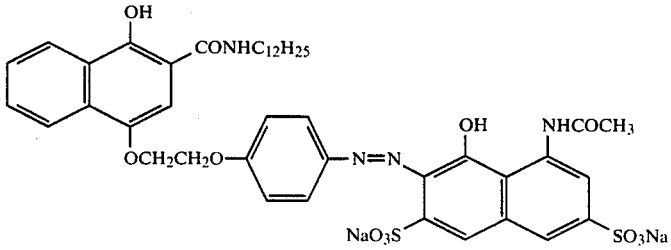
Coupler EX-13:
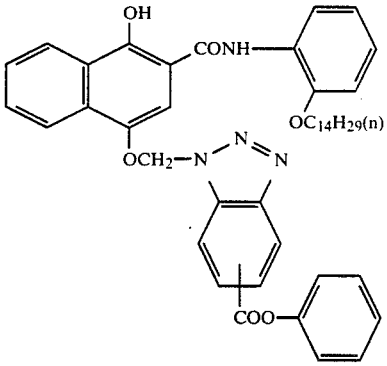
Coupler EX-14:
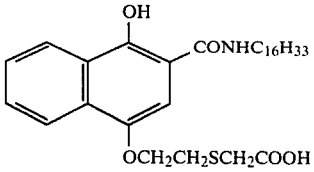
Coupler EX-15:
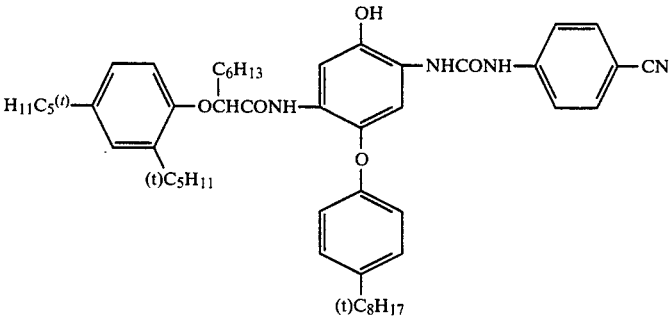
Coupler EX-16:
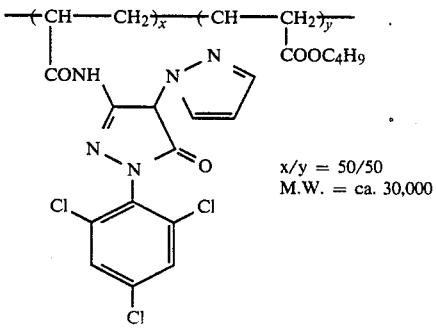
Coupler EX-17:

-continued
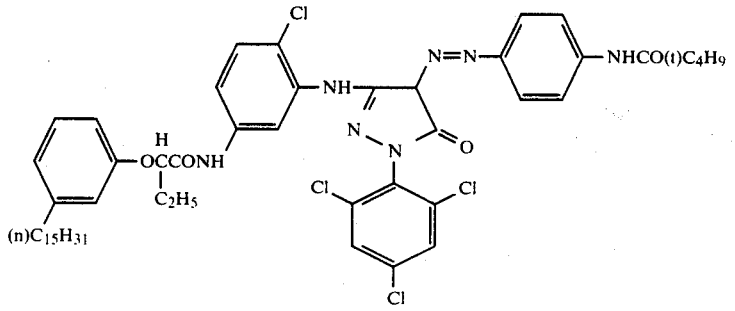
Coupler EX-18:
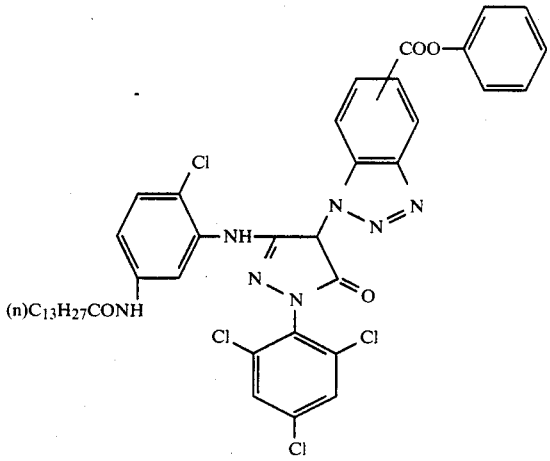
Coupler EX-19:
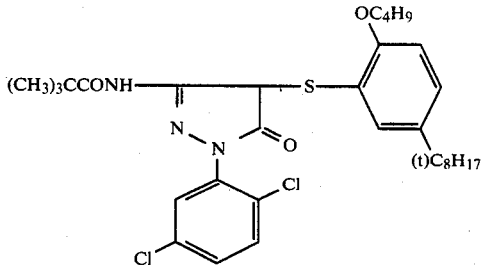
Coupler EX-20:
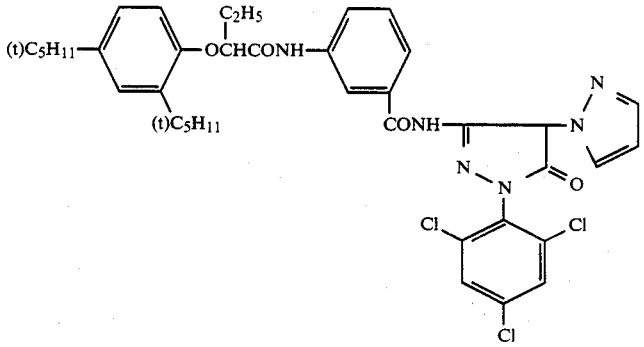
Coupler EX-21:

-continued

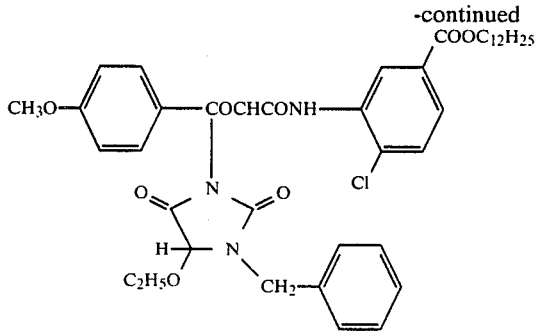

Coupler EX-22:

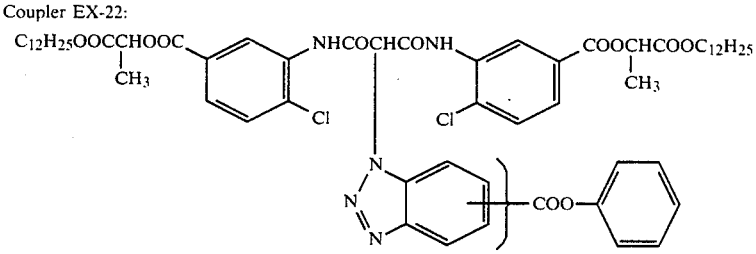

Each of the resulting samples was exposed to light for sensitometry and then subjected to development processing according to Process A or Process B as in Example 3. The density of the sample processed according to Process B with an exposure that provides a density of 1.5 by Process A was measured, and the results obtained are shown in Table 5.

TABLE 5

| Sample No. | Coupler | Density Obtained in Process B with Exposure Providing Density 1.5 in Process A | Remark |
|---|---|---|---|
| 5A | EX-9 | 1.16 | Comparison |
| 5B | (28) | 1.50 | Invention |
| 5C | (30) | 1.49 | Invention |

It can be seen from Table 5 that Sample 5A wherein Coupler EX-9 was used in the third layer undergoes significant reduction in density when processed according to Process B, in which a fatigued bleaching solution was used, while Samples 5B and 5C wherein Couplers (28) and (30) were used, respectively, are substantially free from such reduction in density.

EXAMPLE 6

Onto a cellulose triacetate film support were coated the following layers in the order listed to prepare Light-Sensitive Material 6A.

First Layer: Red-Sensitive Emulsion Layer

Silver iodobromide emulsion (silver iodide content: 5 mol%; mean grain size: 0.4 μm): 1.44 g/m² as Ag Sensitizing Dye V: $4.5\times10^{-4}$ mol per mol of Ag Sensitizing Dye VI: $15.\times10^{-4}$ mol per mol of Ag Coupler EX-23: 0.06 mol per mol of Ag Second Layer: Protective Layer A gelatin layer containing polymethyl methacrylate particles (diameter: ca. 1.5 μm) (gelatin coverage: 1.0 g/m²).

Each of the above-described layers additionally contained Gelatin Hardener H-1 and a surface active agent.

Samples 6B to 6F were prepared in the same manner as described above except that Coupler EX-23 used in the first layer of Sample 6A was replaced by the equimole of Coupler EX-24 and Polymer Couplers IV, XII, XIV and XVI in such amounts that the mole number of the coupler unit thereof equals that of Coupler EX-9.

The compounds used in the preparation of these samples have the following formulae:

Coupler EX-23

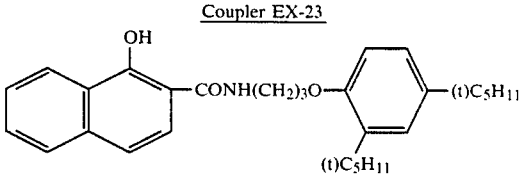

Coupler EX-24

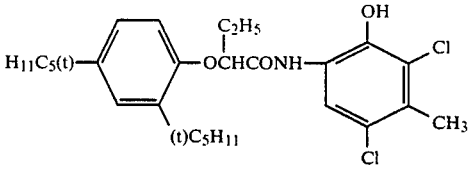

Each of the thus prepared samples was exposed to light for sensitometry and then subjected to development processing in the same manner as in Example 1.

Fastness of the thus formed dye image was tested by preserving the sample in the dark at 100° C. for 14 days or exposing the sample to light for 7 days using a xenon tester (100,000 lux). The results obtained are shown in Table 6.

TABLE 6

| Sample No. | Coupler | Percent Remaining of Dye Image: 100° C., 14 Days (%) | Light, 7 Days (%) | Remark |
|---|---|---|---|---|
| 6A | EX-23 | 75 | 88 | Comparison |
| 6B | EX-24 | 10 | 91 | Comparison |
| 6C | IV | 98 | 96 | Invention |
| 6D | XII | 99 | 97 | Invention |
| 6E | XIV | 99 | 98 | Invention |
| 6F | XVI | 99 | 96 | Invention |

It is apparent from Table 6 that the dye images formed by the couplers according to the present invention are superior in fastness to heat and light.

EXAMPLE 7

A multilayer color light-sensitive material was prepared by coating the following layers in the order listed onto a cellulose triacetate film support. The resulting material was designated as Sample 7A.

First Layer: Antihalation Layer

A gelatin layer containing black colloidal silver (gelatin coverage: 1.5 g/m$^2$).

Second Layer: Intermediate Layer

A gelatin layer containing an emulsified dispersion of 2,5-di-t-octylhydroquinone (gelatin coverage: 1.2 g/m$^2$).

Third Layer: First Red-Sensitive Emulsion Layer

Silver iodobromide emulsion (silver iodide content: 5 mol%): 1.6 g/m$^2$ as Ag
Sensitizing Dye V: $4.5\times10^{-4}$ mol per mol of Ag
Sensitizing Dye VI: $1.5\times10^{-4}$ mol per mol of Ag
Coupler EX-23: 0.03 mol per mol of Ag
Coupler EX-12: 0.003 mol per mol of Ag
Coupler EX-13: 0.0008 mol per mol of Ag
Tricresyl phosphate: 0.6 ml/m$^2$
Gelatin: 2.2 g/m$^2$ Fourth Layer: Second Red-Sensitive Emulsion Layer Silver iodobromide emulsion (silver iodide content: 10 mol%): 1.4 g/m$^2$ as Ag
Sensitizing Dye V: $3\times10^{-4}$ mol per mol of Ag
Sensitizing Dye VI: $1\times10^{-4}$ mol per mol of Ag
Coupler EX-14: 0.005 mol per mol of Ag
Coupler EX-15: 0.017 mol per mol of Ag
Coupler EX-12: 0.0016 mol per mol of Ag
Tricresyl phosphate: 0.3 ml/m$^2$
Gelatin: 1.1 g/m$^2$ Fifth Layer: Intermediate Layer The same as the second layer.

Sixth Layer: First Green-Sensitive Emulsion Layer

Silver iodobromide emulsion (silver iodide content: 4 mol%): 1.2 g/m$^2$ as Ag
Sensitizing Dye VII: $5\times10^{-4}$ mol per mol of Ag
Sensitizing Dye VIII: $2\times10^{-4}$ mol per mol of Ag
Coupler EX-16: 0.05 mol per mol of Ag
Coupler EX-17: 0.008 mol per mol of Ag
Coupler EX-18: 0.0018 mol per mol of Ag
Tricresyl phosphate: 1.3 ml/m$^2$
Gelatin: 1.5 g/m$^2$ Seventh Layer: Second Green-Sensitive Emulsion Layer Silver iodobromide emulsion (silver iodide content: 8 mol%): 1.3 g/m$^2$ as Ag
Sensitizing Dye VII: $3\times10^{-4}$ mol per mol of Ag
Sensitizing Dye VIII: $1.2\times10^{-4}$ mol per mol of Ag
Coupler EX-19: 0.017 mol per mol of Ag
Coupler EX-20: 0.003 mol per ml of Ag
Tricresyl phosphate: 0.4 ml/m$^2$
Gelatin: 1.6 g/m$^2$ Eighth Layer: Yellow Filter Layer A gelatin layer comprising a gelatin aqueous solution containing yellow colloidal silver and an emulsified dispersion of 2,5-di-t-octylhydroquinone (gelatin coverage: 1.5 g/m$^2$).

Nineth Layer: First Blue-Sensitive Emulsion Layer

Silver iodobromide emulsion (silver iodide content: 6 mol%): 0.7 g/m$^2$ as Ag
Coupler EX-21: 0.25 mol per mol of Ag
Coupler EX-22: 0.015 mol per mol of Ag
Tricresyl phosphate: 1.5 ml/m$^2$
Gelatin: 1.2 g/m$^2$ Tenth Layer: Second Blue-Sensitive Emulsion Layer Silver iodobromide emulsion (silver iodide content: 6 mol%): 0.6 g/m$^2$ as Ag
Coupler EX-21: 0.06 mol per mol of Ag
Tricresyl phosphate: 0.2 ml/m$^2$
Gelatin: 1.0 g/m$^2$ Eleventh Layer: First Protective Layer silver iodobromide emulsion (silver iodide content: 1 mol%; mean grain size: 0.07 μm): 0.5 g/m$^2$ as Ag Gelatin layer containing an emulsified dispersion of Ultraviolet Absorbent UV-1 (gelatin coverage: 0.7 g/m$^2$).

Twelfth Layer: Second Protective Layer

A gelatin layer containing polymethyl methacrylate particles (diameter: 1.5 μm) (gelatin coverage: 0.5 g/m$^2$).

Each of the above-described layers additionally contained Gelatin Hardener H-1 and a surface active agent.

Samples 7B to 7C were prepared in the same manner as described above except that Polymer Couplers VI and XIV were used in place of Coupler EX-23 used in the third layer of Sample 7A in such amounts that the mole number of the coupler unit moiety equals that of Coupler tX-23, respectively, and that the coverages of the tricresyl phosphate and gelatin in the third layer were changed to 0.35 ml/m$^2$ and 1.4 g/m$^2$, respectively.

Each of the thus prepared samples was exposed to light for testing sharpness and then subjected to development processing in the same manner as described in Example 1. Sharpness of the cyan image of the thus processed sample was evaluated by an MTF method. The MTF method is defined in T. H. James, *The Theory of The Photographic Process*, 4th Ed., p. 604, Macmillan Publishing Co., Inc. (1977). An MFT value was obtained at a special frequency of 10 cycle/mm. The results obtained are shown in Table 7.

TABLE 7

| Sample No. | Main Coupler in 3rd Layer | MTF | Remark |
|---|---|---|---|
| 7A | EX-23 | 0.87 | Comparison |
| 7B | IV | 1.03 | Invention |
| 7C | XIV | 1.01 | Invention |

It is apparent from Table 7 that Samples 7B and 7C wherein the cyan dye forming polymer couplers according to the present invention were used exhibit greatly improved sharpness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material containing a cyan dye forming coupler represented by formula (I):

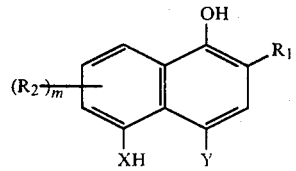

(I)

wherein $R_1$ represents $-CONR_3R_4$, $-NHCOR_3$, $-NHCOOR_5$, $-NHSO_2R_5$, $-NHCONR_3R_4$ or $-NHSO_2NR_3R_4$, wherein $R_3$ and $R_4$ each represent a hydrogen atom or a straight or branched chain or cyclic substituted or unsubstituted alkyl, alkenyl, or alkynyl group, a substituted or unsubstituted aryl group, or a substituted or unsubstituted monocyclic or condensed heterocyclic ring, and $R_5$ represents a straight or branched chain or cyclic substituted or unsubstituted alkyl, alkenyl, or alkynyl group, a substituted or unsubstituted aryl group including a condensed ring, or a substituted or unsubstituted monocyclic or condensed heterocyclic ring; $R_2$ represents a group capable of substituting for a hydrogen atom on the naphthol ring; m represents 0 or an integer of from 1 to 3; X represents an oxygen atom, a sulfur atom, or

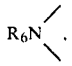

wherein $R_6$ represents a hydrogen atom or a monovalent organic group; and Y represents a hydrogen atom or a group capable of being released in a coupling reaction with an oxidation product of an aromatic primary amine developing agent; when m is 2 or 3, the plural $R_2$ groups can be the same or different, or together form a ring; or $R_2$ and X, X and Y, or $R_3$ and $R_4$ together form a ring; or formula (I) represents a dimer or a higher polymer by bonding at $R_1$, $R_2$, X or Y, wherein the hydrogen atom of OH, SH or $R_6N$ as —XH undergoes intramolecular hydrogen bond formation after the coupling reaction with the oxidation product of the aromatic primary amine developing agent and thus stabilizes the cyan dye images to heat and light.

2. A silver halide color photographic light-sensitive material as in claim 1, wherein the alkyl, alkenyl, or alkynyl group for $R_3$, $R_4$, or $R_5$ contains from 1 to 30 carbon atoms, the aryl group for $R_3$, $R_4$, or $R_5$ contains from 6 to 30 carbon atoms, and the heterocyclic group for $R_3$, $R_4$, or $R_5$ contains from 2 to 30 carbon atoms.

3. A silver halide color photographic light-sensitive material as in claim 1, wherein the group $R_2$ contains from 0 to 30 carbon atoms.

4. A silver halide color photographic light-sensitive material as in claim 1, wherein $R_1$ is $—CONR_3R_4$.

5. A silver halide color photographic light-sensitive material as in claim 4, wherein $R_1$ is a carbamoyl group, an ethylcarbamoyl group, a morpholinocarbonyl group, a dodecylcarbamoyl group, a hexadecylcarbamoyl group, a decyloxypropyl group, a dodecyloxypropyl group, a 2,4-di-t-amylphenoxypropyl group, or a 2,4-di-t-amylphenoxybutyl group.

6. A silver halide color photographic light-sensitive material as in claim 1, wherein m is 0.

7. A silver halide color photographic light-sensitive material as in claim 1, wherein m is from 1 to 3 and $R_2$ is a halogen atom, a straight or branched chain or cyclic substituted or unsubstituted alkyl, alkenyl, or alkynyl group, a carbonamido group, or a sulfonamido group.

8. A silver halide color photographic light-sensitive material as in claim 1, wherein the monovalent organic group for $R_6$ is represented by formula (II)

$$R_7(Y')_l— \quad (II)$$

wherein Y' represents an imino group, a carbonyl group, or a sulfonyl group; l represents 0 or 1; and $R_7$ represents a hydrogen atom, a straight or branched chain or cyclic substituted or unsubstituted alkyl, alkenyl or alkynyl group having from 1 to 30 carbon atoms, a substituted or unsubstituted aryl group having from 6 to 30 carbon atoms, a substituted or unsubstituted monocyclic or condensed heterocyclic group having from 2 to 30 carbon atoms, a hydroxyl group, $—OR_3$, $—COR_3$, $—SO_2R_3$, or

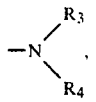

wherein $R_3$ and $R_4$ are as defined in claim 1.

9. A silver halide color photographic light-sensitive material as in claim 1, wherein X is

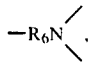

wherein $R_6$ is $—COR_7$, $—COOR_3$, $—SO_2R_7$, $—CONR_3R_4$ or 13 $SO_2NR_3R_4$, wherein $R_3$ and $R_4$ are as defined in claim 1, and $R_7$ represents a hydrogen atom, a straight or branched chain or cyclic substituted or unsubstituted alkyl, alkenyl or alkynyl group having from 1 to 30 carbon atoms, a substituted or unsubstituted aryl group having from 6 to 30 carbon atoms, a substituted or unsubstituted monocyclic or condensed heterocyclic group having from 2 to 30 carbon atoms, a hydroxyl group, $—OR_3$, $—COR_3$, $—SO_2R_3$,

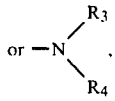

wherein $R_3$ and $R_4$ are as defined in claim 1.

10. A silver halide color photographic light-sensitive material as in claim 9, wherein X is $—COR_7$ or $—SO_2R_7$, wherein $R_7$ is as defined in claim 9.

11. A silver halide color photographic light-sensitive material as in claim 1, wherein the releasable group for Y is a halogen atom, $—OR_8$, $—SR_8$,

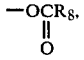

$—NHCOR_8$, $—NHOS_2R_8$,

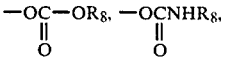

an aromatic azo group having from 6 to 30 carbon atoms, or a heterocyclic group having from 1 to 30 carbon atoms which is bonded to the coupling active position of the coupler at a nitrogen atom thereof, wherein $R_8$ represents a straight or branched chain or cyclic substituted or unsubstituted alkyl, alkenyl or alkynyl group having from 1 to 30 carbon atoms, a substituted or unsubstituted aryl group having from 6 to 30 carbon atoms, or a substituted or unsubstituted monocyclic or condensed heterocyclic group having from 2 to 30 carbon atoms.

12. A silver halide color photographic light-sensitive material as in claim 1, wherein Y is a hydrogen atom, a halogen atom, an aliphatic oxy group, an aromatic oxy group, a heterocyclic thio group, or an aromatic azo group.

13. A silver halide color photographic light-sensitive material as in claim 1, wherein the polymer is a copolymer comprising a monomer which provides the repeating unit represented by formula (III) as defined in claim 13 and a non-color forming ethylenically unsaturated monomer.

14. A silver halide color photographic light-sensitive material as in claim 13, wherein the non-color forming ethylenically unsaturated monomer is an acrylic ester, a methacrylic ester, or a maleic ester.

15. A silver halide color photographic light-sensitive material as in claim 13, wherein the copolymer comprises from 5 to 80% by weight of the repeating unit of formula (III).

16. A silver halide color photographic light-sensitive material as in claim 13, wherein the copolymer comprises from 20 to 70% by weight of the repeating unit of formula (III).

17. A silver halide color photographic light-sensitive material as in claim 1, wherein said cyan dye forming coupler of formula (I) is present in a silver halide emulsion layer in an amount of from 0.002 to 1.0 mol per mol of the silver halide.

18. A silver halide color photographic light-sensitive material as in claim 1, wherein said cyan dye forming coupler of formula (I) is present in a silver halide emulsion layer in an amount of from 0.005 to 0.3 mol per mol of the silver halide.

19. A silver halide color photographic light-sensitive material as in claim 1, wherein the polymer is a homopolymer or copolymer containing a repeating unit represented by formula (III)

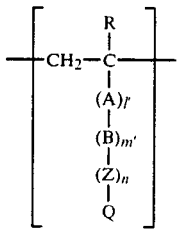

(III)

wherein R represents a hydrogen atom, a chlorine atom or an alkyl group having from 1 to 4 carbon atoms; A represents —CONH—, —COO— or a substituted or unsubstituted phenylene group; B represents a substituted or unsubstituted alkylene, phenylene or aralkylene group; Z represents —CONH—, —NHCONH—, —NHCOO—, —NHCO—, —OCONH—, —NH—, —COO—, —OCO—, —O—, —S—, —$SO_2$—, —NH-$SO_2$—, or —$SO_2$NH—; l', m' and n each represents 0 or 1; and Q represents a cyan coupler residue derived from the compound represented by formula (I) as defined in claim 1 by releasing a hydrogen atom from one of the groups $R_1$, $R_2$, XH and Y of the formula I.

20. A silver halide color photographic light-sensitive material as in claim 1, wherein $R_3$ and $R_4$ are selected from the group consisting of a hydrogen atom, a methyl group, an ethyl group, a butyl group, a cyclohexyl group, an allyl group, a propargyl group, a methoxyethyl group, an n-decyl group, an n-dodecyl group, an n-hexadecyl group, a trifluoromethyl group, a heptafluoropropyl group, a dodecyloxypropyl group, a 2,4-di-t-amylphenoxypropyl group, a 2,4-di-t-amylphenoxybutyl group, a phenyl group, a tolyl group, a 2-tetradecyloxyphenyl group, a pentafluorophenyl group, a 2-chloro-5-dodecyloxycarbonylphenyl group, a 4-chlorophenyl group, a 4-cyanophenyl group, a 4-hydroxyphenyl group, a 2-pyridyl group, a 4-pyridyl group, a 2-furyl group, a 4-thienyl group and a quinolinyl group, and $R_2$ is selected from the group consisting of a halogen atom, a hydroxyl group, an amino group, a carboxyl group, a sulfo group, a cyano group, an aromatic group, a heterocyclic group, a carbonamindo group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group and an imido group.

* * * * *